US008456110B2

(12) United States Patent
Takayama et al.

(10) Patent No.: US 8,456,110 B2
(45) Date of Patent: Jun. 4, 2013

(54) INDUCTION ACCELERATING DEVICE AND ACCELERATION METHOD OF CHARGED PARTICLE BEAM

(75) Inventors: Ken Takayama, Tsuchiura (JP); Kota Torikai, Tsukuba (JP); Yoshio Arakida, Tsukuba (JP); Yoshito Shimosaki, Sayo-cho (JP)

(73) Assignee: Inter-University Research Institute Corporation, Tsukuba-shi, Ibaraki (JP)

( * ) Notice: Subject to any disclaimer, the term of this patent is extended or adjusted under 35 U.S.C. 154(b) by 710 days.

(21) Appl. No.: 12/097,657

(22) PCT Filed: Dec. 11, 2006

(86) PCT No.: PCT/JP2006/325129

§ 371 (c)(1),
(2), (4) Date: Feb. 22, 2011

(87) PCT Pub. No.: WO2007/069749

PCT Pub. Date: Jun. 21, 2007

(65) Prior Publication Data

US 2011/0156617 A1 Jun. 30, 2011

(30) Foreign Application Priority Data

Dec. 16, 2005 (JP) ..... 2005-362921

(51) Int. Cl.
*H05H 15/00* (2006.01)

(52) U.S. Cl.
USPC ..... 315/503

(58) Field of Classification Search
USPC ..... 315/500, 501, 502, 503, 504, 505, 315/506
See application file for complete search history.

(56) References Cited

U.S. PATENT DOCUMENTS 5,168,241 A * 12/1992 Hirota et al. ..... 315/500
5,814,940 A * 9/1998 Fujisawa ..... 315/5.41
6,433,494 B1 * 8/2002 Kulish et al. ..... 315/500
6,809,310 B2 * 10/2004 Chen ..... 250/251

FOREIGN PATENT DOCUMENTS

JP 2007-18849 A 1/2007
WO 2006-118065 A1 11/2006

OTHER PUBLICATIONS

Ken Takayama et al., Progress in Induction Synchrotron R&D: First result of induction acceleration n the KEK Proton Synchrotron, AIP conference Proceedings, US, American Institute of Physice, Jun. 8, 2005, vol. 773, p. 281-285.
Kota Torikai et al. Superbunch Projet Team, First Induction Acceleration of a Proton Bunch in a Circular Ring, Nov. 2004.

(Continued)

*Primary Examiner* — Minh D A
(74) *Attorney, Agent, or Firm* — Westerman, Hattori, Daniels & Adrian, LLP

(57) ABSTRACT

The present invention provides a set of induction accelerating cell for controlling acceleration of a charged particle beam and an induction accelerating device for controlling generation timing of an induced voltage applied by the induction accelerating cell in a synchrotron. The induction accelerating device in a synchrotron includes: an induction accelerating cell that applies an induced voltage; a switching power supply that supplies a pulse voltage to the induction accelerating cell via a transmission line and drives said induction accelerating cell; a DC power supply that supplies electric power to the switching power supply; and an intelligent control device including a pattern generator that generates a gate signal pattern for controlling on/off the switching power supply, and a digital signal processing device that controls on/off a gate master signal that becomes the basis of the gate signal pattern.

10 Claims, 18 Drawing Sheets

OTHER PUBLICATIONS

Ken Takayama et al. AII-ION Accelerator: A New Turn of the Induction Synchrotron, Proceedings of the 2nd Annual Meeting of Particle Accelerator Society of Japan and the 30th Linear Accelerator Meeting in Japan, JP, Particle Accelerator Society of Japan, Jul. 2005, p. 132-135.

Kota Torikai et al. Pop Experiment (I) of Induction Synchrotron: Induction Acceleration of a Single RF Bunch and Formation of a Superbunch in the KEK-PS, Proceedings of the 2nd Annual Meeting of Particle Accelerator Society of Japan and the 30th Linear Accelerator Meeting in Japan, JP, Particle Accelerator Society of Japan, Jul. 2005, p. 34-36.

Kota Torikai et al. Induction system for a Proton Bunch Acceleration in Synchrotron, Proceedings of 2005 Particle Accelerator Conference, Oct. 28, 2005, p. 1398-1400.

Ken Takayama et al. Induction Acceleration of a Single RF Bunch in the KEK PS, Proceedings of 2005 Particle Accelerator Conference, Oct. 28, 2005, p. 1579-1681.

Kota Torikai et al. Induction Accelerating Cavity for a Circular Ring Accelerator, Proceedings of EPAC Nov. 24, 2004, p. 704-706.

International Search Report of PCT/JP2006/325129 and date of mailing Feb. 27, 2007.

* cited by examiner (A)

(B)

INDUCTION ACCELERATING DEVICE AND ACCELERATION METHOD OF CHARGED PARTICLE BEAM

TECHNICAL FIELD

The present invention relates to an induction accelerating device that controls generation timing of an induced voltage applied from an induction accelerating cell and allows acceleration of a charged particle beam in a synchrotron using the induction accelerating cell, and an acceleration method of a charged particle beam.

BACKGROUND ART

Charged particles collectively refer to "particles with charges" such as ions that are certain elements in the periodic table in a certain positive or negative charge state, and electrons. Further, the charged particles include particles consisting of a large number of molecules such as compounds or protein.

Synchrotrons include rf synchrotrons and synchrotrons using an induction accelerating cell. An rf synchrotron is a circular accelerator for applying, with an rf acceleration cavity, an rf acceleration voltage synchronized with a magnetic field excitation pattern of a bending magnet that ensures strong focusing of a design orbit along which a charged particle beam circulates to charged particles such as protons injected into a vacuum duct by an injector, and circulating the charged particles along the design orbit in the vacuum duct.

In the rf synchrotron, the injected charged particles in the form of several bunches circulate along the design orbit of the rf synchrotron. When a bunch arrives at the rf acceleration cavity, the bunch receives the rf acceleration voltage synchronized with the magnetic field excitation pattern to be accelerated up to a predetermined energy level.

The bunch refers to a group of charged particles that circulate along the design orbit with phase stability.

A voltage required for acceleration calculated from an inclination (the time rate of change) of the magnetic field excitation pattern of the bending magnet is applied to the bunch as an rf acceleration voltage. The rf acceleration voltage has both the function of supplying the voltage required for accelerating the bunch, and the function of confinement for preventing diffusion of the bunch in an advancing axis direction.

These two functions are essential for accelerating the bunch in the rf synchrotron. The function of confinement is sometimes particularly referred to as phase stability. The phase stability refers to a state in which, by the rf acceleration voltage, individual charged particles receive focusing forces in the advancing axis direction and are formed into a bunch, and circulate in the rf synchrotron while moving forward and backward in the advancing axis direction of the charged particles in the bunch. Time periods are limited in which the rf acceleration voltage has the two functions.

On the other hand, a synchrotron using an induction accelerating cell has a different acceleration principle from the rf synchrotron, and is a circular accelerator for applying an induced voltage to a charged particle beam with the induction accelerating cell for acceleration. FIG. 16 shows an acceleration principle of charged particles by an induction accelerating cell.

FIG. 16 shows the acceleration principle of a charged particle beam by induced voltages applied from conventional induction accelerating cells having different functions. The induction accelerating cells are classified according to their functions into an induction accelerating cell for confinement of charged particle beams in the advancing axis direction (hereinafter referred to as an induction accelerating cell for confinement), and an induction accelerating cell for applying induced voltages for accelerating the charged particle beams in the advancing axis direction (hereinafter referred to as an induction accelerating cell for acceleration).

An rf acceleration cavity may be used for confinement of a bunch 3 in the advancing axis direction instead of the induction accelerating cell for confinement. Thus, conventional acceleration of the charged particle beams using the induced voltages requires the two functions of acceleration and confinement.

FIG. 16(A) shows confinement of the bunch 3 by the induction accelerating cell for confinement. The induced voltages applied to the bunch 3 by the induction accelerating cell for confinement are barrier voltages 17.

Particularly, a barrier voltage 17 applied to a bunch head 3*d* in a direction opposite to the advancing axis direction of the bunch 3 is a negative barrier voltage 17*a*, and a voltage value thereof is a negative barrier voltage value 17*c*. A barrier voltage 17 applied to a bunch tail 3*e* in the same direction as the advancing axis direction of the bunch 3 is a positive barrier voltage 17*b*, and a voltage value thereof is a positive barrier voltage value 17*d*.

These barrier voltages 17 provide phase stability to the bunch 3 like the conventional radio frequency waves. The axis of abscissa t represents changes with time in the induction accelerating cell for acceleration, and the axis of ordinate v represents an applied barrier voltage value (an induced voltage value for acceleration in FIG. 16(B)).

FIG. 16(B) shows acceleration of the bunch 3 by the induction accelerating cell for acceleration. Induced voltages applied to the bunch 3 by the induction accelerating cell for acceleration are induced voltages for acceleration 18. Particularly, an induced voltage for acceleration 18 applied to the entire bunch 3 from the bunch head 3*d* to the bunch tail 3*e* and required for accelerating the bunch 3 in the advancing axis direction is an acceleration voltage 18*a*, and a voltage value thereof is an acceleration voltage value. A time period when the acceleration voltage 18*a* is applied is a charging time period 18*e*.

An induced voltage for acceleration 18 having a different polarity from the acceleration voltage 18*a* in a time period when no bunch 3 exists in the induction accelerating cell for acceleration is a reset voltage 18*b*, and a voltage value thereof is a reset voltage value 18*d*. The reset voltage 18*b* avoids magnetic saturation of the induction accelerating cell for acceleration.

It is considered that the barrier voltages 17 and the induced voltages for acceleration 18 allow acceleration of protons, which has been demonstrated as disclosed in "Phys. Rev. Lett. Vol. 94, No. 144801-4 (2005)" as Non-Patent Document 1.

Further, as disclosed in the bulletin of the Physical Society of Japan Vol. 59, No. 9 (2004) p 601-p 610 as Non-Patent Document 2, it is considered that the use of the induction accelerating cell allows acceleration of a bunch 3 (superbunch) of 1 μsec corresponding to a time width of several to ten times the length of the beam accelerated by the conventional rf synchrotron.

FIG. 17 shows synchrotron oscillation. In the confinement and acceleration methods of the charged particles in the advancing axis direction in the rf synchrotron, it is known that a phase space area in which the bunch 3 can be confined is restricted in principle particularly in the advancing axis direction (time axis direction).

Specifically, in a time area where the radio frequency waves 36 are at a negative voltage, the bunch 3 is reduced in speed, and in a time area with a different polarity of a voltage gradient, the charged particles diffuse in the advancing axis direction and are not confined. In other words, only an acceleration area 36*a* shown by the double-headed dotted arrow can be used for accelerating the bunch 3.

In the acceleration area 36*a*, the phase of the radio frequency waves 36 is moved and controlled to apply a center acceleration voltage 3*f* that is a constant voltage to a bunch center 3*c*. Thus, the charged particles positioned in the bunch head 3*d* have higher energy and arrive earlier at the rf acceleration cavity than the bunch center 3*c* does, and thus receive a lower head acceleration voltage 3*g* than the center acceleration voltage 3*f* received in the bunch center 3*c* and reduce their speed.

On the other hand, the charged particles positioned in the bunch tail 3*e* have lower energy and arrive later at the rf acceleration cavity than the bunch center 3*c* does, and thus receive a greater tail acceleration voltage 3*h* than the center acceleration voltage 3*f* received in the bunch center 3*c* and increase their speed. During the acceleration, the charged particles repeat this process.

This is phase stability, and the phase stability, resonance acceleration, and strong focusing are three main principles for allowing synchrotron acceleration of charged particles.

A state where the phase stability is provided to the bunch 3, and the charged particles that constitute the bunch 3 rotate forward and backward in an acceleration direction symmetrically with respect to the bunch center 3*c* is synchrotron oscillation 3*i*, and a rotation frequency of the charged particles at the time is a synchrotron oscillation frequency.

The confinement is a function required because the charged particles that constitute the bunch 3 always have variations in kinetic energy. The variations in kinetic energy cause differences in time for the bunch 3 to arrive at the same position after one turn along the design orbit. Without the confinement, the time difference is increased for each turn, and the charged particles diffuse over the entire design orbit.

When positive and negative induced voltages are applied to opposite ends of the bunch 3, energy is transferred to particles delayed in revolution because of insufficient energy by the positive induced voltage, entering an energy excessive state, and energy is lost from charged particles advanced in revolution because of excessive energy by the negative induced voltage, entering an energy insufficient state.

Thus, the particles delayed in revolution are advanced, while the particles advanced in revolution are delayed, thereby allowing the bunch 3 to be localized in a certain area in the advancing axis direction. The series of operations is referred to as the confinement of the bunch 3.

The function of the induction accelerating cell for confinement is thus equal to the separated function of confinement of the conventional rf acceleration cavity.

The devices for confinement have the function of reducing the length of the charged particle beam injected from an injection device into the synchrotron using the induction accelerating cell to be formed into the bunch 3 having a certain length so that the charged particle beam can be accelerated by another induction accelerating cell with a predetermined induced voltage having a different polarity or changing the length of the bunch 3 in various ways, and the function of providing phase stability to the bunch 3 during acceleration.

The devices for acceleration have the function of providing the induced voltage for acceleration 18 to the entire bunch 3 after the formation of the bunch 3.

In the conventional rf synchrotron, a phenomenon is known in which radio frequency waves unpredictable in a design stage are applied to the bunch 3 from devices that constitute the rf synchrotron. This phenomenon is referred to as disturbance. The disturbance is electromagnetic waves generated by the devices that constitute the synchrotron, and applied to the bunch 3 as a constant rf frequency depending on installation states for each acceleration.

When the frequency of the synchrotron oscillation 3*i* of the bunch 3 matches or becomes integer times the frequency of the disturbance, resonance with the synchrotron oscillation 3*i* is induced, the charged particles are displaced from ideal energy, and the bunch 3 diffuses in the advancing axis direction, exceeds the time width of the acceleration area 36*a* of the radio frequency waves 36 and is lost. Similarly, when the induction accelerating cell for acceleration is used for accelerating the charged particle beam, the bunch 3 exceeds the length of the charging time period 18*e* of the acceleration voltage 18*a* and is lost.

For example, the charged particles in the bunch head 3*d* receive the rf acceleration voltage in a direction opposite to the acceleration direction, cannot be synchronized with the magnetic field excitation pattern of the synchrotron, collide with a wall surface of the vacuum duct and are lost.

In the acceleration of the charged particles, the loss of the particles reduces acceleration efficiency, and also causes a significant problem of activation of a spot of the collision with the wall surface of the vacuum duct to no small extent because any charged particles have high energy.

Thus, in conventional acceleration of charged particles, a synchrotron oscillation frequency is controlled by an amplitude changing device that can change the amplitude of radio frequency waves to avoid a match with the frequency of disturbance for preventing loss of charged particles by the disturbance.

Thus, the charged particle beam cannot be actually accelerated by the induced voltage without controlling the synchrotron oscillation frequency.

FIG. 18 shows an example of a forming process of a super-bunch by a conventional induced voltage. For forming the super-bunch 3*m*, it is necessary to inject the bunch 3 into the vacuum duct multiple times and connect multiple bunches 3.

In FIG. 18(A), a method of injecting the multiple bunches 3, and then connecting a further bunch 3 to a temporally long bunch 3*o* constituted by the bunches 3 successively connected before acceleration will be described. The super-bunch 3*m* is formed after the injection of the multiple bunches 3 and before confinement and acceleration of each bunch 3 with the barrier voltages 17.

The negative barrier voltage 17*a* and the positive barrier voltage 17*b* are applied to the bunch head 3*d* and the bunch tail 3*e*, respectively, of the bunch 3*o* to perform confinement for each turn. At this time, generation timing of the barrier voltages 17 is constant.

To the bunch 3 to be connected to the bunch 3*o*, negative and positive barrier voltages 17*a* and 17*b* are applied by an induction accelerating cell for movement separate from the induction accelerating cell for confinement, and the bunch 3 is brought close to the bunch 3*o* while being confined. For bringing the bunch 3 close to the bunch 3*o*, generation timing of a barrier voltage for movement 17*g* is gradually advanced.

This shortens a time duration between generations of the barrier voltage 17 used only for confinement and the barrier voltage for movement 17*g* (hereinafter referred to as a time duration between barrier voltage pulses 17*h*), and the bunch 3 is brought close to the bunch 3*o* (in the direction of the open arrow in the drawing) for each turn.

Finally, the positive barrier voltage of the bunch 3*o* is generated in a position corresponding to the bunch tail 3*e* of the bunch 3 to integrally connect the bunch 3*o* and the bunch 3. It has been considered that the super-bunch 3*m* is thus formed (FIG. 18(B)).

It has been considered that the super-bunch 3*m* thus formed can be confined by the barrier voltages 17 including the negative barrier voltage 17*a* and the positive barrier voltage 17*b*, and accelerated by the induced voltage for acceleration 18 applied from the induction accelerating cell for acceleration separate from the induction accelerating cell for confinement.

However, the conventional acceleration of the charged particle beam by the induced voltage requires combination of induction accelerating cells and devices for controlling generation timing of induced voltages applied by the induction accelerating cells for each function of the induced voltages. For example, required combinations include an induction accelerating cell for acceleration, an induction accelerating cell for confinement, an induction accelerating cell for movement, an induction accelerating cell for synchrotron oscillation frequency control, and an induction accelerating cell for charged particle beam orbit control, and devices for controlling induced voltages applied by the induction accelerating cells.

Thus, each of the induced voltages needs to be controlled, which is complicated. Also, the combinations of the induction accelerating cells having respective functions and the devices for controlling the generation timing of the induced voltages applied by the induction accelerating cells need to be prepared, which increases construction costs of the accelerator.

Thus, the present invention has a first object to provide an induction accelerating cell for controlling acceleration of a charged particle beam and a set of induction accelerating device for controlling generation timing of an induced voltage applied by the induction accelerating cell in a synchrotron.

The present invention has a second object to provide an acceleration method of a charged particle beam by induced voltages having the same pulse shape, by using the induction accelerating device to control generation timing of the induced voltage.

The present invention has a third object to provide an accelerator that can accelerate arbitrary charged particles up to an arbitrary energy level permitted by magnetic field strength of a bending magnet that constitutes a synchrotron using an induction accelerating cell (hereinafter referred to as an arbitrary energy level) with one accelerator, by using the induction accelerating device.

DISCLOSURE OF THE INVENTION

In order to solve the above described problems, first, the present invention provides an induction accelerating device 5 in a synchrotron 1, including characterized in that the induction accelerating device includes: an induction accelerating cell 6 that applies a barrier voltage for confinement of a charged particle beam in an advancing axis direction and positive and negative induced voltages 8 having the same rectangular pulse shape that function as induced voltages for acceleration; a switching power supply 5*b* that supplies a pulse voltage 6*f* to the induction accelerating cell 6 via a transmission line 5*a* and drives the induction accelerating cell 6; a DC power supply 5*c* that supplies electric power to the switching power supply 5*b* ; and an intelligent control device 7 including a pattern generator 13 that generates a gate signal pattern 13*a* for controlling on/off the switching power supply 5*b* , and a digital signal processing device 12 that controls on/off a gate master signal 12*a* that becomes the basis of the gate signal pattern 13*a*, and the induction accelerating device controls generation timing of the induced voltages, wherein a plurality of the induction accelerating devices 5 are provided. induced voltages are applied from a plurality of induction accelerating cells 6 to a bunch 3 that has reached the induction accelerating cells 6 at the same turn to change values of the induced voltages applied to the charged particle beam, or application timing of the induced voltages applied from the plurality of induction accelerating cells 6 is shifted to change charging time periods 18*e* for applying the induced voltages to the charged particle beam, and wherein the digital signal processing device 12 includes: a variable delay time calculator 20 that stores a required variable delay time pattern 14*b* corresponding to an ideal variable delay time pattern 14*a* calculated on the basis of magnetic field excitation patterns 15 and 24, and generates a variable delay time signal 20*a* on the basis of the required variable delay time pattern 14*b* ; a variable delay time generator 21 that receives a passage signal 9*a* of the bunch 3 from a bunch monitor 9 placed on a design orbit 2 along which the charged particle beam circulates and the variable delay time signal 20*a* from the variable delay time calculator 20 to generate a pulse 21*a* corresponding to a variable delay time 14; an induced voltage arithmetic unit 22 that stores an equivalent acceleration voltage value pattern 18*j* corresponding to an ideal acceleration voltage value pattern 18*f* calculated on the basis of the magnetic field excitation patterns 15 and 24, and receives the pulse 21*a* corresponding to the variable delay time 14 from the variable delay time generator 21 to generate a pulse 22*a* for controlling on/off the induced voltage 8; and a gate master signal output device 23 that receives the pulse 22*a* from the induced voltage arithmetic unit 22 to generate the gate master signal 12*a* that is a pulse suitable for the pattern generator 13, and outputs the gate master signal 12*a* after a lapse of the variable delay time 14, the variable delay time calculator 20 calculates the variable delay time 14 in real time on the basis of a beam deflection magnetic field strength signal 4*b* for indicating magnetic field strength of a bending magnet 4 that constitutes the synchrotron 1, and a revolution frequency of the charged particle beam on the design orbit 2, and generates the variable delay time signal 20*a* on the basis of the variable delay time 14, and the induction accelerating device 5 controls generation timing of the induced voltages 8.

Second, the present invention provides an acceleration method of a charged particle beam in a synchrotron 1, characterized by including the steps of: controlling generation timing of induced voltages 8 including a positive induced voltage 8*a* having the same rectangular pulse shape and a negative induced voltage 8*b* having the same rectangular pulse shape, applied from a set of induction accelerating device 5; intermittently applying an induced voltage for acceleration 18 as an equivalent acceleration voltage value pattern 18*j* corresponding to an ideal acceleration voltage valuepattern 18*f* without applying the induced voltages 8 for each turn of a bunch 3 in a unit of control 15*c* that is the number of turns of the bunch 3 in a certain time period; and applying a barrier voltage 17 for confinement of the charged particle beam and an induced voltage for controlling a synchrotron oscillation frequency in a time period without application of the induced voltage for acceleration 18; and thus temporally separating functions of the barrier voltage 17 for confinement of the charged particle beam in an advancing axis direction 3*a* and the induced voltage for acceleration 18 for accelerating the charged particle beam.

Third, the present invention provides an accelerator 26 for accelerating arbitrary charged particle beam up to an arbitrary energy level, characterized by including: an injection device 29 including an ion source 30 that generates charged particles, a preinjector 31 that accelerates the charged particles up to a certain energy level, and an injector 32 that injects a charged particle beam accelerated by the preinjector 31 into an annular vacuum duct 2*a* having a design orbit 2 therein; an induction accelerating synchrotron 27 including a bending electromagnet 4 that is provided on a curved portion of the design orbit 2 and ensures the design orbit 2 of the charged particle beam (a bunch 3), a focusing electromagnet 28 that is provided on a linear portion of the design orbit 2 and ensures strong focusing of the charged particle beam, a bunch monitor 9 that is provided in the vacuum duct 2*a* and detects passage of the charged particle beam, and an induction accelerating device 5 connected to the vacuum duct 2*a* for controlling acceleration of the charged particle beam; and an extraction device 33 including an extractor 34 that extracts the charged particle beam accelerated up to a predetermined energy level by the induction synchrotron 27 to a beam utility line 35, and a transport pipe 34*a*, wherein the induction accelerating device 5 includes: an induction accelerating cell 6 that applies an induced voltage 8; a switching power supply 5*b* that supplies a pulse voltage 6*f* to the induction accelerating cell 6 via a transmission line 5*a* and drives the induction accelerating cell 6; a DC power supply 5*c* that supplies electric power to the switching power supply 5*b*; and an intelligent control device 7 including a pattern generator 13 that generates a gate signal pattern 13*a* for controlling on/off the switching power supply 5*b* , and a digital signal processing device 12 that controls on/off a gate master signal 12*a* that becomes the basis of the gate signal pattern 13*a*, wherein a plurality of the induction accelerating devices 5 are provided, induced voltages are applied from a plurality of induction accelerating cells 6 to a bunch 3 that has reached the induction accelerating cells 6 at the same turn to change values of the induced voltages applied to the charged particle beam, or application timing of the induced voltages applied from the plurality of induction accelerating cells 6 is shifted to change charging time periods 18*e* for applying the induced voltages to the charged particle beam, wherein the digital signal processing device 12 includes: a variable delay time calculator 20 that stores a required variable delay time pattern 14*b* corresponding to an ideal variable delay time pattern 14*a* calculated on the basis of magnetic field excitation patterns 15 and 24, and generates a variable delay time signal 20*a* on the basis of the required variable delay time pattern 14*b* ; a variable delay time generator 21 that receives a passage signal 9*a* that is passage information of the bunch 3 from the bunch monitor 9 placed on the design orbit 2 along which a charged particle beam circulates and the variable delay time signal 20*a* from the variable delay time calculator 20 to generate a pulse 21*a* corresponding to a variable delay time 14; an induced voltage arithmetic unit 22 that stores an equivalent acceleration voltage value pattern 18*j* corresponding to an ideal acceleration voltage value pattern 18*f* calculated on the basis of the magnetic field excitation patterns 15 and 24, and receives the pulse 21*a* corresponding to the variable delay time 14 from the variable delay time generator 21 to generate a pulse 22*a* for controlling on/off the induced voltage 8; and a gate master signal output device 23 that receives the pulse 22*a* from the induced voltage arithmetic unit 22 to generate the gate master signal 12*a* that is a pulse suitable for the pattern generator 13, and outputs the gate master signal 12*a* after a lapse of the variable delay time 14, and the induction accelerating device 5 controls generation timing of the induced voltage 8, and wherein the preinjector 31 is an electrostatic accelerator, a linear induction accelerator, or a small-sized cyclotron.

Alternatively, the variable delay time calculator 20 calculates the variable delay time 14 in real time on the basis of a beam deflection magnetic field strength signal 4*b* for indicating magnetic field strength of the bending magnet 4 that constitutes the synchrotron 1, and a revolution frequency of the charged particle beam on the design orbit 2, and generates the variable delay time signal 20*a* on the basis of the variable delay time 14.

Alternatively, the induced voltage arithmetic unit 22 calculates an acceleration voltage value 18*c* in real time on the basis of the beam deflection magnetic field strength signal 4*b* for indicating the magnetic field strength of the bending magnet 4 that constitutes the synchrotron 1, receives the pulse 21*a* corresponding to the variable delay time 14 from the variable delay time generator 21 to generate the pulse 22*a* for controlling on/off an induced voltage for acceleration 18.

BEST MODE FOR CARRYING OUT THE INVENTION

Figure 1:
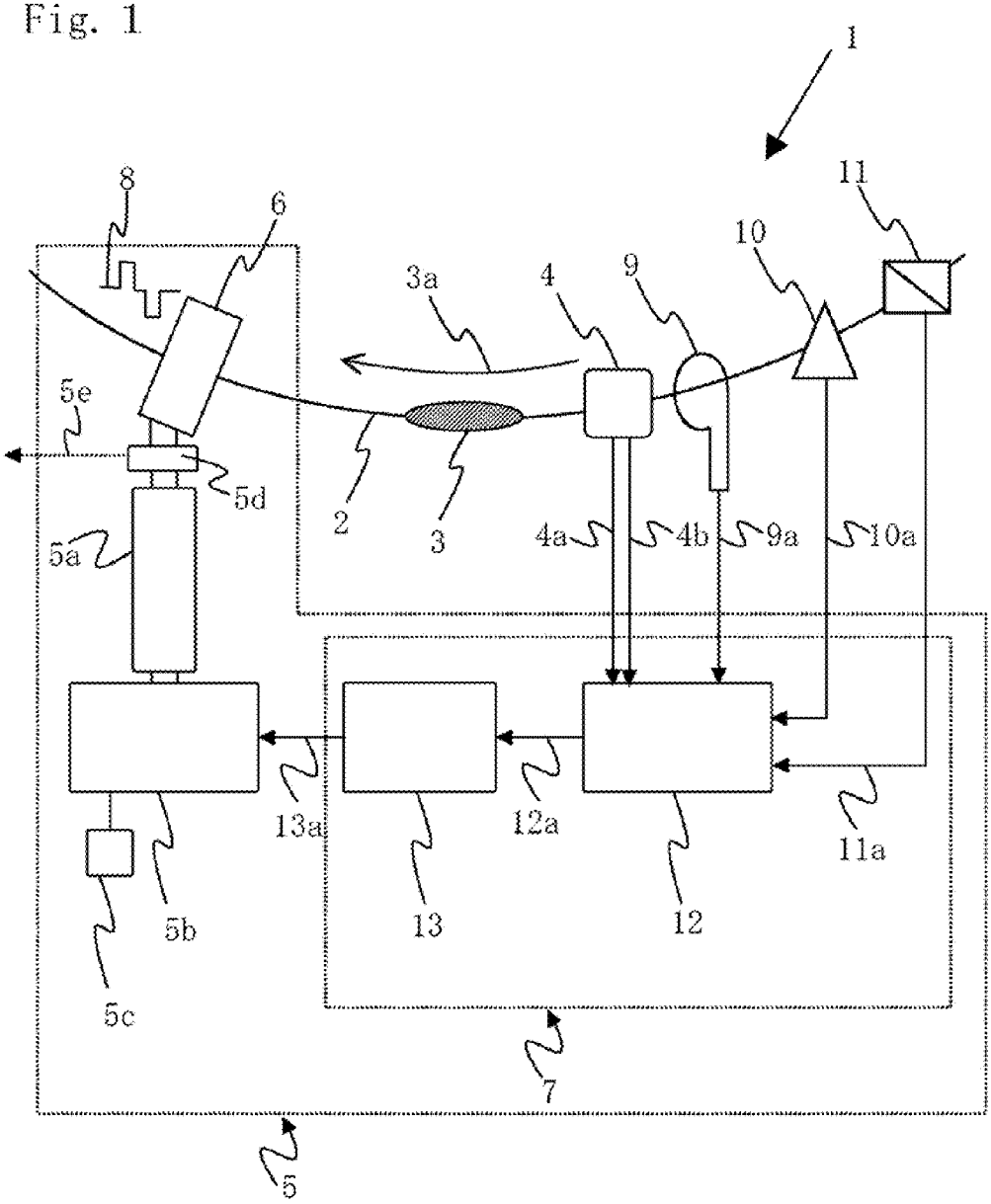
FIG. 1 is a schematic view of a synchrotron using an induction accelerating cell including the present invention.

An acceleration method of a charged particle beam of a synchrotron 1 is achieved characterized in that the method includes the steps of: controlling generation timing of induced voltages 8 including a positive induced voltage 8*a* and a negative induced voltage 8*b* applied from a set of induction accelerating device 5; intermittently applying the induced voltages; and thus temporally separating functions of a barrier voltage 17 for confinement of a charged particle beam in an advancing axis direction 3*a* and an induced voltage for acceleration 18 for accelerating the charged particle beam.

Now, an induction accelerating device and a control method thereof according to the present invention will be described in detail with reference to the accompanying drawings.

FIG. 1 is a schematic view of a synchrotron using an induction accelerating cell including an induction accelerating device according to the present invention.

The synchrotron 1 using the induction accelerating cell 6 including the induction accelerating device 5 according to the present invention includes: a bending magnet 4 that ensures a design orbit 2 in a vacuum duct along which an injected bunch 3 circulates; a focusing magnet that ensures strong focusing; a bunch monitor 9 that detects various kinds of information on a charged particle beam during acceleration, a speed monitor 10, and a position monitor 11.

The induction accelerating device 5 includes: an induction accelerating cell 6 that is connected to the vacuum duct having the design orbit 2 therein along which the bunch 3 circulates, and applies, to positively charged particles, induced voltages 8 having different functions including a negative barrier voltage 17*a* applied to a bunch head 3*d* in a direction opposite to an advancing axis direction 3*a* of the bunch 3, a positive barrier voltage 17*b* applied to a bunch tail 3*e* in the same direction as the advancing axis direction 3*a* of the bunch 3, an acceleration voltage 18*a* for acceleration in the advancing axis direction 3*a*, and a reset voltage 18*b* that has a different polarity from the acceleration voltage 18*a* and avoids magnetic saturation of the induction accelerating cell 6; a switching power supply 5*b* that supplies a pulse voltage 6*f* to the induction accelerating cell 6 via a transmission line 5*a* and is repeatedly operable; a DC power supply 5*c* that supplies electric power to the switching power supply 5*b*, an intelligent control device 7 that performs feedback control of on/off of the switching power supply 5*b*; and an induced voltage monitor 5*d* for checking the value of an induced voltage applied from the induction accelerating cell 6.

In the present invention, an induced voltage 8 in the same direction as the advancing axis direction 3*a* such as the positive barrier voltage 17*b* or the acceleration voltage 18*a* is a positive induced voltage 8*a*. An induced voltage 8 in the direction opposite to the advancing axis direction 3*a* such as the negative barrier voltage 17*a* or the reset voltage 18*b* is a negative induced voltage 8*b*. When negatively charged particles are accelerated, positive and negative signs of the induced voltages 8 are reversed.

The intelligent control device 7 in the present invention includes a pattern generator 13 that generates a gate signal pattern 13*a* for controlling on/off the switching power supply 5*b*, and a digital signal processing device 12 that calculates a gate master signal 12*a* that becomes the basis of the gate signal pattern 13*a* generated by the pattern generator 13.

The gate signal pattern 13*a* is a pattern for controlling the induced voltages 8 applied from the induction accelerating cell 6. The pattern includes a signal for determining charging time periods and generation timing of the induced voltages 8 in application of the induced voltages 8, and a signal for determining a rest time between the positive induced voltage 8*a* and the negative induced voltage 8*b*. Thus, the gate signal pattern 13*a* can be adjusted to the length of the bunch 3 to be accelerated.

The pattern generator 13 converts the gate master signal 12*a* into a combination of on and off of a current path of the switching power supply 5*b*.

The switching power supply 5*b* generally has a plurality of current paths, adjusts currents passing through branches thereof, and controls directions of the currents to generate positive and negative voltages in a load (herein the induction accelerating cell 6).

The induction accelerating cell 6 is the same as conventional induction accelerating cells for confinement and acceleration. However, the conventional induction accelerating cells for confinement and acceleration require devices for controlling generation timing of different induced voltages for applying induced voltages having different functions, while in the induction accelerating cell 6 in the present invention, generation timing of the induced voltages 8 having the same rectangular pulse shape including the barrier voltage 17 for confinement of the bunch 3 and the induced voltage for acceleration 18 for accelerating the bunch 3 is controlled using one intelligent control device 7.

Figure 2:
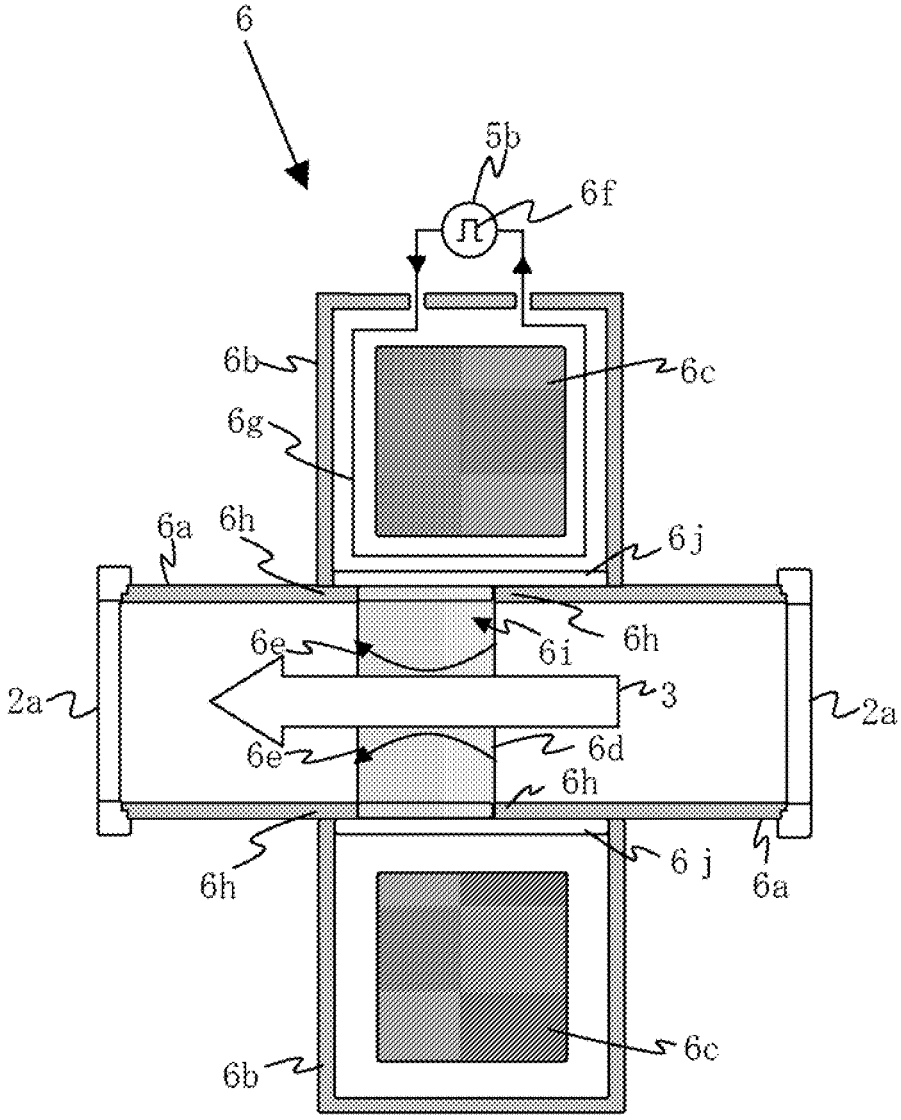
FIG. 2 is a sectional schematic diagram of the induction accelerating cell connected to a vacuum duct.

FIG. 2 is a sectional schematic diagram of the induction accelerating cell connected to the vacuum duct. The induction accelerating cell 6 has the same structure in principle as an induction accelerating cell for a linear induction accelerator constructed heretofore.

The induction accelerating cell 6 has a double structure of an inner cylinder 6*a* and an outer cylinder 6*b*, and a magnetic material 6*c* is inserted into the outer cylinder 6*b* to produce an inductance. Part of the inner cylinder 6*a* connected to the vacuum duct 2*a* in which the bunch 3 circulates is made of an insulator 6*d* such as ceramic.

When a pulse voltage 6*f* is applied from the DC power supply 5*c* connected to the switching power supply 5*a* to a primary side electric circuit surrounding the magnetic material 6*c*, a primary current 6*g* (core current) flows through a primary side conductor. The primary current 6*g* generates a magnetic flux around the primary side conductor to excite the magnetic material 6*c* surrounded by the primary side conductor.

This temporally increases the density of the magnetic flux passing through the magnetic material 6*c* of toroidal shape. During this time period, the electric field is induced according to Faraday's induction law in an insulator portion on a secondary side including opposite ends 6*h* of the inner cylinder 6*a* of the conductor with the insulator 6*d* in between. The induced electric field becomes an electric field 6*e*.

A portion where the electric field 6*e* is produced is an acceleration gap 6*i*. Thus, the induction accelerating cell is equivalent to a one-to-one transformer. Since the induction accelerating cell 6 generates heat in use, cooling oil or the like is circulated in the outer cylinder 6*b* in some cases, which requires an insulator seal 6*j*.

The switching power supply 5*b* that generates the pulse voltage 6*f* is connected to the primary side electric circuit of the induction accelerating cell 6, and the switching power supply 5*b* is externally turned on/off to freely control the production of the acceleration electric field.

Figure 3:
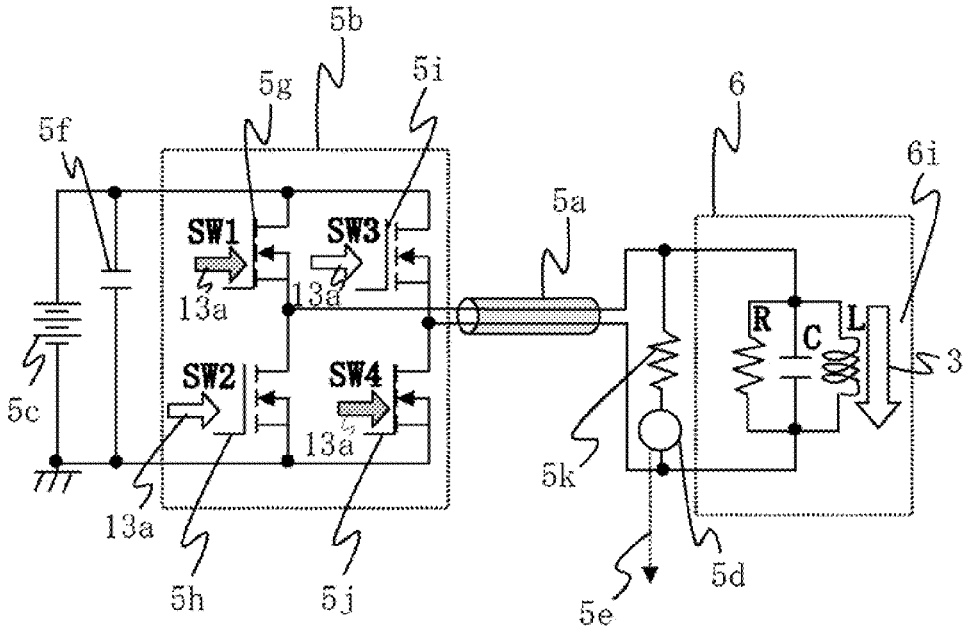
FIG. 3 is an equivalent circuit diagram of a switching voltage and the induction accelerating cell that constitute an induction accelerating device.

FIG. 3 is an equivalent circuit diagram of a switching voltage and the induction accelerating cell that constitute the induction accelerating device. In the equivalent circuit, the switching power supply 5*b* always charged by the DC power supply 5*c* connects to the induction accelerating cell 6 via the transmission line 5*a*.

The induction accelerating cell 6 includes a parallel circuit of an induction component L, a capacity component C, and a resistance component R. The voltage across the parallel circuit is the induced voltage 8 applied to the bunch 3.

In the circuit in FIG. 3, a first switch 5*g* and a fourth switch 5*j* are turned on by the gate signal pattern 13*a*, a voltage charged in a bank capacitor 5*f* is applied to the induction accelerating cell 6, and the positive induced voltage 8*a* that functions as the acceleration voltage 18*a* is generated in an acceleration gap 6*i*.

The positive induced voltage 8*a* that functions as the positive barrier voltage 17*b* for confinement of the bunch 3 in the acceleration gap 6*i* is similarly applied. However, there are differences in generation timing, and in that the acceleration voltage 18*a* is applied to the entire bunch 3 while the positive barrier voltage 17*b* is applied to the bunch tail 3*e*.

Then, the first switch 5*g* and the fourth switch 5*j* are turned off by the gate signal pattern 13*a*. At this time, the induced voltage 8 is off.

Next, a second switch 5*h* and a third switch 5*i* are turned on by the gate signal pattern 13*a*, and the negative induced voltage 8*b* that functions as the reset voltage 18*b* is generated. The generation timing is limited in a time period without the bunch 3.

The negative induced voltage 8*b* that functions as the negative barrier voltage 17*a* in the direction opposite to the positive induced voltage 8*a* for confinement of the bunch 3 in the acceleration gap 6*i* is similarly applied, and the magnetic saturation of the magnetic material 6*c* of the induction accelerating cell 6 that has occurred in the generation of the positive induced voltage 8*a* is reset.

Similarly, the first switch 5*g* and the fourth switch 5*j* that have been turned on are turned off by the gate signal pattern 13*a*. Also at this time, the induced voltage 8 is off.

The first switch 5*g* and the fourth switch 5*j* are again turned on by the gate signal pattern 13*a*. The series of switching operations are repeated by the gate signal pattern 13*a* to allow confinement and movement of the bunch 3, control of the orbit of the charged particle beam, control of a synchrotron oscillation frequency, and acceleration of the charged particle beam.

The gate signal pattern 13*a* is a signal for controlling driving of the switching power supply 5*b*, and is digitally controlled by the intelligent control device 7 including the digital signal processing device 12 and the pattern generator 13 on the basis of the passage signal 9*a* of the bunch 3 from the bunch monitor 9.

The induced voltage 8 applied to the bunch 3 is equal to a value calculated from the product of a current value and matching resistance 5*k* in the circuit. Thus, the current value can be measured by an ammeter that is the induced voltage monitor 5*d* to check the value of the applied induced voltage 8.

Thus, the value of the induced voltage 8 obtained from the induced voltage monitor 5*d* can be fed back to the digital signal processing device 12 as the induced voltage signal 5*e* and used for next generation of the gate master signal 12*a*.

In order to accelerate the charged particle beam by the induced voltage 8 controlled by the set of induction accelerating device 5, it is necessary to control the synchrotron oscillation frequency, control the generation timing of the induced voltage 8 so as to match the passage of the bunch 3, and apply an acceleration voltage value 18*c* synchronized with a magnetic field excitation pattern.

The synchrotron oscillation frequency control can be realized by applying the positive and negative induced voltages 8*a* and 8*b* that function as the barrier voltages 17 to the bunch 3 besides providing phase stability.

To control the generation timing of the induced voltage 8, it is necessary to synchronize the generation timing with the passage of the bunch 3.

Further, the charged particle beam during acceleration changes in the number of turns (a revolution frequency ($f_{REV}$)) along the design orbit 2 per unit time with the passage of acceleration time. For example, when a proton beam is accelerated by a 12 GeV proton rf synchrotron (hereinafter referred to as 12 GeVPS) by High energy accelerator research organization (hereinafter referred to as KEK), the revolution frequency of the proton beam changes from 667 kHz to 882 kHz.

Since an accelerator including the synchrotron 1 using the induction accelerating cell 6 is installed in a broad site, long cables including signal wires connecting the devices that constitute the accelerator need to be routed. The speed of signals transmitted through the signal wires is finite.

Thus, if the configuration of the accelerator is changed, time for the signals to pass through each device is not necessarily the same as before the change. Thus, in the accelerator including the synchrotron 1 using the induction accelerating cell 6, timing of charging time periods 8*c* and 8*d* need to be reset for each change of components.

Figure 4:
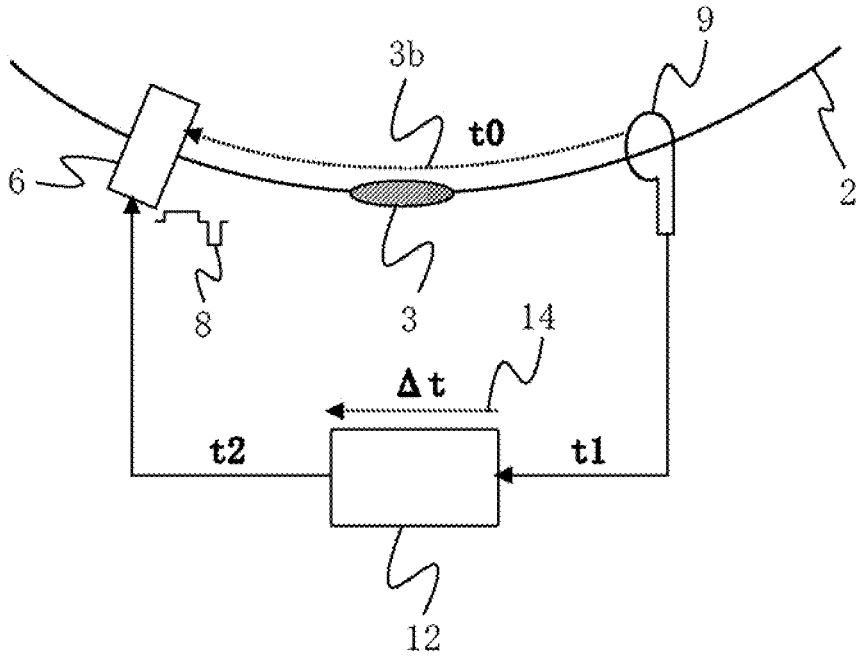
FIG. 4 illustrates a variable delay time.

Then, a variable delay time is used. Now, the variable delay time will be described. FIG. 4 illustrates a variable time. The variable delay time 14 is a time period between generation of the passage signal 9*a* from the bunch monitor 9 and application of the induced voltage 8, which is adjusted by the digital signal processing device 12 for controlling the generation timing of the induced voltage 8 according to the position of the bunch 3 on the design orbit 2.

At an acceleration stage of the charged particle beam, the generation timing is controlled so that the negative induced voltage 8*b* that functions as the negative barrier voltage 17*a* is applied to the bunch head 3*d*, the positive induced voltage 8*a* that functions as the positive barrier voltage 17*b* is applied to the bunch tail 3*e*, the positive induced voltage 8*a* that functions as the acceleration voltage 18*a* is applied to the entire bunch 3, and the negative induced voltage 8*b* that functions as the reset voltage 18*b* is applied in a time period when no bunch 3 exists in the induction accelerating cell 6.

Specifically, in the digital signal processing device 12, a time period between receiving the passage signal 9*a* from the bunch monitor 9 and the generation of the gate master signal 12*a* is controlled.

Δt that represents the variable delay time 14 is calculated by the following formula (1):

$$\Delta t = t_0 - (t_1 + t_2) \qquad \text{Formula (1)}$$

where $t_0$ is a movement time 3*b* of the bunch 3 from the bunch monitor 9 placed on the design orbit 2 to the induction accelerating cell 6, $t_1$ is a transmission time of the passage signal 9*a* from the bunch monitor 9 to the digital signal processing device 12, and $t_2$ is a transmission time required for applying the induced voltage 8 by the induction accelerating cell 6 on the basis of the gate master signal 12*a* output from the digital signal processing device 12.

For example, if the movement time 3*b* ($t_0$) of the bunch 3 from the bunch monitor 9 to the induction accelerating cell 6 at a certain acceleration stage is 1 μsec, the transmission time $t_1$ of the passage signal 9*a* is 0.2 μsec, and the transmission time $t_2$ required between the generation of the gate master signal 12*a* and the generation of the induced voltage 8 is 0.3 μsec, the variable delay time 14 is 0.5 μsec.

$\Delta t$ changes with acceleration because $t_0$ changes with acceleration of the bunch 3. Thus, to control the generation timing of the induced voltage 8 according to the position of the bunch 3 and apply the induced voltage 8 to the bunch 3, $\Delta t$ needs to be calculated for each turn of the bunch 3. On the other hand, $t_1$ and $t_2$ are constant once the devices that constitute the synchrotron 1 using the induction accelerating cell 6 are installed.

$t_0$ can be calculated from the revolution frequency ($f_{REV}(t)$) of the bunch 3 and a length (L) of the design orbit 2 along which the bunch 3 moves from the bunch monitor 9 to the induction accelerating cell 6, or may be actually measured.

Now, a method of calculating $t_0$ from the revolution frequency ($f_{REV}/(t)$) of the bunch 3 will be described. $t_0$ can be calculated in real time by the following formula (2):

$$t_0=L/(f_{REV}(t)\cdot C_0)[\text{sec}] \quad \text{Formula (2)}$$

where $C_0$ is the entire length of the design orbit 2 along which the bunch 3 circulates. $f_{REV}(t)$ is calculated by the following formula (3):

$$f_{REV}(t)=\beta(t)\cdot c/C_0[\text{Hz}] \quad \text{Formula (3)}$$

wherein $\beta(t)$ is a relativistic particle speed, and c is the speed of light ($c=2.998\times10^8$ [m/s]). $\beta(t)$ is calculated by the following formula (4):

$$\beta(t)=\sqrt{(1-(1/(\gamma(t)^2))}[\text{dimensionless}] \quad \text{Formula (4)}$$

wherein $\gamma(t)$ is a relativistic coefficient. $\gamma(t)$ is calculated by the following formula (5):

$$\gamma(t)=1+\Delta T(t)/E_0[\text{dimensionless}] \quad \text{Formula (5)}$$

wherein $\Delta T(t)$ is an increment of energy transferred by the acceleration voltage 18*a*, and $E_0$ is the static mass of the charged particles. $\Delta T(t)$ is calculated by the following formula (6).

$$\Delta T=\rho\cdot C_0\cdot e\cdot\Delta B(t)[\text{eV}] \quad \text{Formula (6)}$$

wherein $\rho$ is a radius of curvature of the bending magnet 4, $C_0$ is the entire length of the design orbit 2 along which the bunch 3 circulates, e is an amount of charge of the charged particles, and $\Delta B(t)$ is an increment of beam deflection magnetic field strength from the start of acceleration.

The static mass ($E_0$) of the charged particles and the amount of charge (e) of the charged particles are different depending on the kinds of the charged particles.

Thus, the variable delay time 14 is uniquely determined by the revolution frequency of the bunch 3 if a distance (L) between the bunch monitor 9 and the induction accelerating cell 6 and the entire length ($C_0$) of the design orbit 2 along which the bunch 3 circulates are determined. The revolution frequency of the bunch 3 is also uniquely determined by the magnetic field excitation pattern.

The variable delay time 14 required at a certain acceleration time is also uniquely determined if the kind of the charged particles and setting of the synchrotron 1 using the induction accelerating cell 6 are determined. Thus, if it is supposed that the bunch 3 is ideally accelerated according to the magnetic field excitation pattern, the variable delay time 14 may be previously calculated by the definition formulas.

The series of formulas for calculating the variable delay time 14 ($\Delta t$) are referred to as definition formulas, and the definition formulas are provided to a variable delay time calculator 20 described later of the digital signal processing device 12 in calculating the variable delay time 14 ($\Delta t$) in real time.

The variable delay time 14 thus provided is output to a variable delay time generator 21 as a variable delay time signal 20*a* that is digital data described later.

Figure 5:
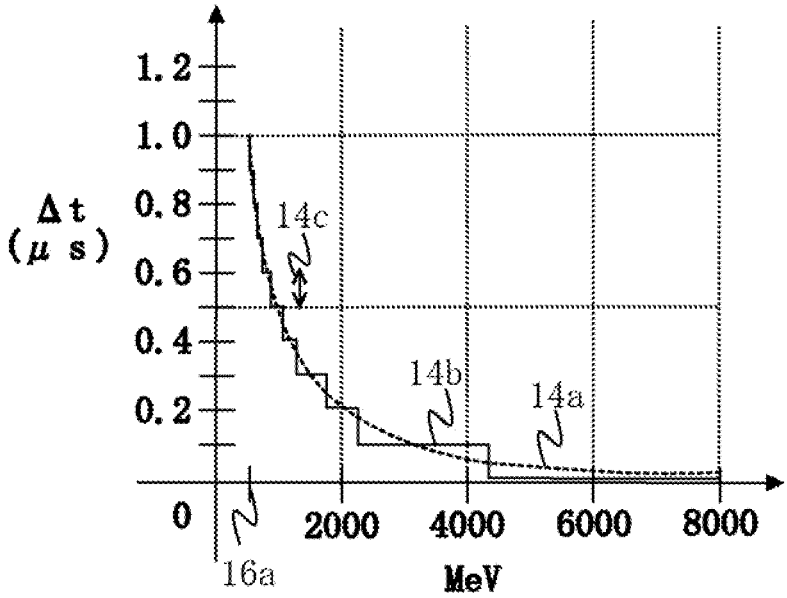
FIG. 5 shows a relationship between an acceleration energy level and the variable delay time.

FIG. 5 shows a relationship between an acceleration energy level and the variable delay time. The graph in FIG. 5 shows a relationship between an energy level of a proton beam and an output time of the variable delay time 14. Data in FIG. 5 are values when a proton beam is injected into KEK 12 GeVPS.

The axis of abscissa MeV represents the energy level of the proton beam, and the unit is megavolt. One MeV is on million electronic volts and corresponds to $1.602\times10^{-13}$ joules.

The axis of ordinate $\Delta t$ (μs) represents the delay of output timing (variable delay time 14) of the gate signal pattern 13*a* for controlling the acceleration voltage 18*a* generated by the induction accelerating cell 6 with the time of the passage of the bunch 3 through the bunch monitor 9 as zero, and the unit is microsecond. The variable delay time 14 receives the passage signal 9*a* from the bunch monitor 9 and is controlled by the digital signal processing device 12 as described above.

The energy level of the proton beam is uniquely determined by the revolution speed of the proton beam. The revolution speed of the proton beam is synchronized with the magnetic field excitation pattern of the synchrotron 1. Thus, the variable delay time 14 can be previously calculated from the revolution speed or the magnetic field excitation pattern rather than is calculated in real time.

The graph in FIG. 5 shows an ideal variable delay time pattern 14*a* and a required variable delay time pattern 14*b* corresponding to the ideal variable delay time pattern 14*a*.

The ideal variable delay time pattern 14*a* refers to a variable delay time 14 corresponding to changes in energy level and required in a time period between the passage of the bunch 3 through the bunch monitor 9 and output of the gate master signal 12*a* by the digital signal processing device 12 if adjusted for each turn of the bunch 3 of the proton beam for applying the acceleration voltage 18*a* according to changes in revolution speed of the bunch 3.

The required variable delay time pattern 14*b* refers to a variable delay time 14 corresponding to changes in energy level in which the acceleration voltage 18*a* can be applied to the bunch 3, like the ideal variable delay time pattern 14*a*.

It is ideally desirable that the variable delay time 14 is calculated and controlled for each turn of the bunch 3, but the required variable delay time pattern 14*b* that is a stepwise variable delay time 14 may be provided because the highest control accuracy of a pulse 21*a* of the variable delay time generator 21 corresponding to the variable delay time 14 achieved by the current technique is ±0.01 μs, and sufficiently efficient acceleration can be performed without loss of charged particles even if the variable delay time 14 is not calculated and controlled for each turn of the bunch 3.

Thus, the variable delay time 14 is controlled by a certain time unit. This unit is referred to as a control time unit 14*c*, and herein 0.1 μs.

In the graph in FIG. 5, the proton beam immediately after injection 16*a* with a low energy level requires a variable delay time 14 of about 1.0 μs in acceleration of KEK 12 GeVPS.

Further, the energy level of the proton beam increases with acceleration time, which reduces the variable delay time 14. Particularly, in a region from about 4500 MeV to near the finish of acceleration, the variable delay time 14 approaches zero.

Thus, in the synchrotron 1 using the induction accelerating cell 6, the induction accelerating device 5 according to the present invention is used to allow arbitrary charged particles with arbitrary revolution frequency to be easily accelerated up to an arbitrary energy level, by replacing an equivalent acceleration voltage value pattern 18*j* calculated from a magnetic field excitation pattern by the variable delay time calculator 20 described later with a magnetic field excitation pattern corresponding to selected charged particles, or with the required variable delay time pattern 14*b* corresponding to the ideal variable delay time pattern 14*a* calculated from the magnetic field excitation pattern.

Figure 6:
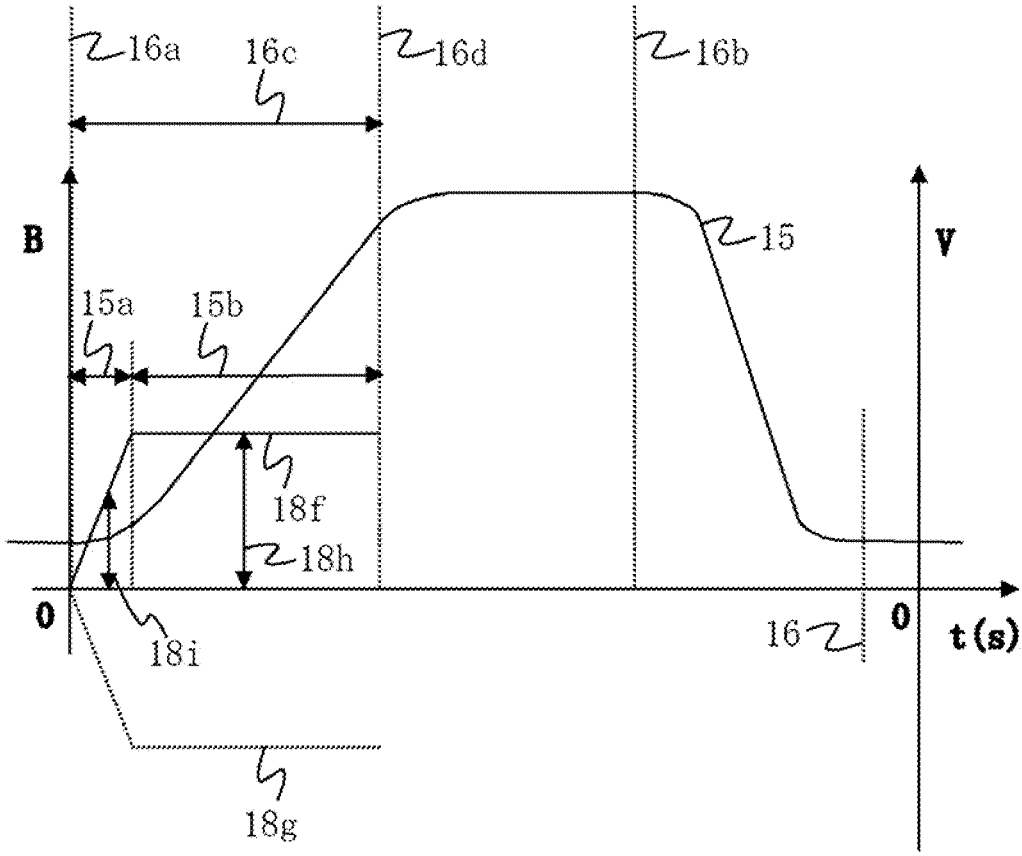
FIG. 6 shows a relationship between a slow cycling and an acceleration voltage.

FIG. 6 shows a relationship between a slow cycling and an acceleration voltage. FIG. 6 shows a magnetic field excitation pattern 15 in acceleration of the proton beam by the KEK 12 GeVPS.

The axis of abscissa t represents an operating time with reference to a time when the charged particle beam is injected 16*a* into the synchrotron 1 using the induction accelerating cell 6. The first axis of ordinate B represents magnetic field strength of the bending magnet 4 that constitutes the synchrotron 1 using the induction accelerating cell 6. The second axis of ordinate v represents the acceleration voltage value 18*c*.

The slow cycling refers to acceleration by the magnetic field excitation pattern 15 of the synchrotron 1 with slow cycling of one cycle 16 of about several seconds, one cycle starting from a time when the charged particles are injected 16*a* from a preinjector, and going through an acceleration time 16*c* and extraction 16*b* to the next injection 16*a*.

The magnetic field excitation pattern 15 is gradually increased in magnetic field strength immediately after the injection 16*a* of the charged particle beam, and enters the maximum magnetic field excitation state at the time of the extraction 16*b*. Particularly, the magnetic field strength is exponentially increased immediately after the injection 16*a* of the charged particle beam. The magnetic field excitation pattern 15 in this time period is referred to as a nonlinear excitation area 15*a*. Then, the magnetic field strength is linear-functionally increased until the finish of the acceleration 16*d*. The magnetic field excitation pattern 15 in this time period is referred to as a linear excitation area 15*b*.

Thus, to accelerate the charged particle beam with the synchrotron 1 using the induction accelerating cell 6, it is necessary to generate the positive induced voltage 8*a* that functions as the acceleration voltage 18*a* in synchronization with the magnetic field excitation pattern 15.

An ideal acceleration voltage value 18*c* (Vacc) synchronized with the magnetic field excitation pattern 15 of the synchrotron 1 has a relationship as expressed in the following formula (7).

$$Vacc \propto dB/dt \qquad \text{Formula (7)}$$

The ideal acceleration voltage value 18*c* thus calculated is referred to as an ideal acceleration voltage value pattern 18*f*. A reset voltage value 18*d* in an opposite sign to the ideal acceleration voltage value pattern 18*f* is referred to as an ideal reset voltage value pattern 18*g*.

Specifically, a required acceleration voltage value 18*c* in a certain time is proportional to the time rate of change of the magnetic field excitation pattern 15 in the time. Thus, in the nonlinear excitation area 15*a*, the magnetic field strength is quadratically increased, and a required acceleration voltage value 18*i* changes linearly in proportional to the changes in the acceleration time 16*c*.

On the other hand, an ideal acceleration voltage value 18*h* in the linear excitation area 15*b* is constant irrespective of the changes in the acceleration time 16*c*.

Since the acceleration voltage 18*a* cannot be continuously applied as described above, the reset voltage 18*b* needs to be applied after the acceleration voltage 18*a*.

Thus, to synchronize the acceleration voltage 18*a* with the magnetic field excitation pattern 15 of the nonlinear excitation area 15*a*, it is necessary to increase the acceleration voltage value 18*c* with time changes. However, the induction accelerating cell 6 itself includes no adjustment mechanism of the induced voltage value, and thus an acceleration voltage value 18*c* of a constant value only can be obtained.

On the other hand, it is supposed that a charging voltage of the bank capacitor 5*f* generated by the induction accelerating cell 6 is controlled to change the acceleration voltage value 18*c*. However, the bank capacitor 5*f* is originally provided for controlling changes in charging voltage with output changes, and thus the method of changing the charging voltage of the bank capacitor 5*f* cannot be actually used for quickly controlling the acceleration voltage value 18*c*.

Figure 7:
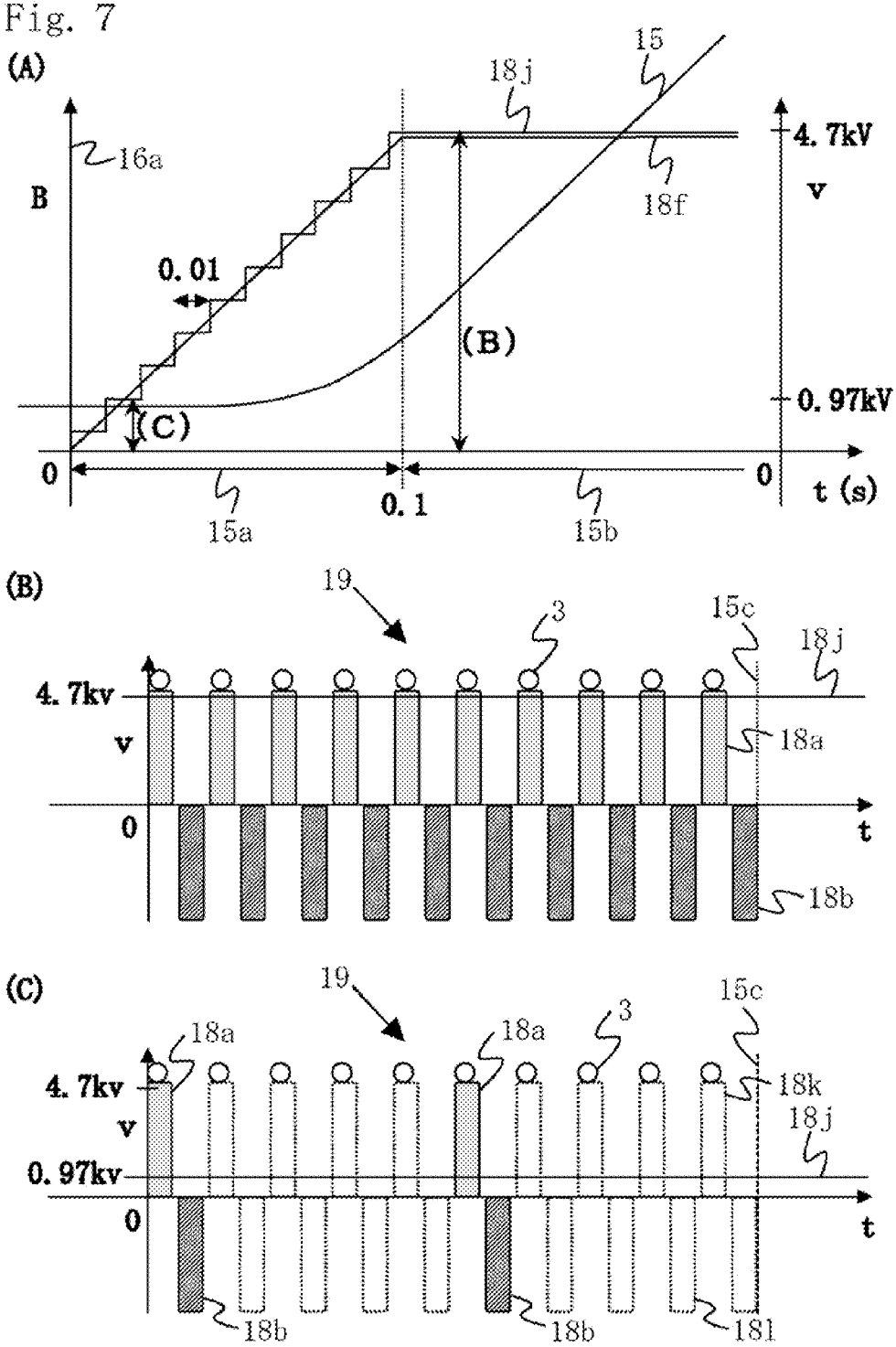
FIG. 7 shows a control method of the acceleration voltage by changing the pulse density.

Thus, pulse density in FIG. 7 is adopted, and the induction accelerating device 5 is used to synchronize the generation timing of the acceleration voltage 18*a* with the magnetic field excitation pattern 15 of the nonlinear excitation area 15*a*.

FIG. 7 shows a control method of the acceleration voltage by changing the pulse density. FIG. 7(A) is an enlarged view of part of the acceleration time 16*c* in FIG. 6. Reference characters t, B and V represent the same as in FIG. 6.

FIG. 7(B) shows pulse density 19 of the induced voltage for acceleration 18 in a certain number of turns of the bunch 3 in the linear excitation area 15*b* in FIG. 7(A). FIG. 7(C) shows pulse density 19 in the nonlinear excitation area 15*a* in FIG. 7(A).

A group of generation timing of the induced voltage for acceleration 18 is referred to as the pulse density 19. The number of turns of the bunch 3 for controlling the pulse density 19 every certain number of turns is herein referred to as a unit of control 15*c*.

To accelerate the proton beam in synchronization with the significantly changing magnetic field excitation pattern 15, first, it is necessary that the induction accelerating cell 6 that can apply the acceleration voltage value 18*h* required in the linear excitation area 15*b* can apply the acceleration voltage 18*a* that is a constant voltage value for each turn of the proton beam.

For example, when the acceleration voltage value 18*h* required in the linear excitation area 15*b* is 4.7 kV from the relationship in Formula (7), an induction accelerating cell 6 that can apply the acceleration voltage 18*a* of 4.7 kV or more is required. The pulse density 19 at that time is shown in FIG. 7(B).

FIG. 7(B) shows that the acceleration voltage value 18*h* required in the linear excitation area 15*b* in FIG. 7(A) is 4.7 kV, and thus adjustment is made so that the acceleration voltage 18*a* of 4.7 kV is applied for each turn of the bunch 3, and the reset voltage 18*b* is applied.

Next, it is necessary to provide the ideal acceleration voltage value pattern 18*f* to the bunch 3 for synchronization with the nonlinear excitation area 15*a*. For this purpose, even with the induction accelerating cell 6 that can apply only the acceleration voltage 18*a* of a constant value, the number of times of application of the acceleration voltage 18*a* is adjusted in the unit of control 15*c* to allow an acceleration voltage value 18*c* equivalent to the ideal acceleration voltage value pattern 18*f* to be provided.

Specifically, the number of times of application of the acceleration voltage 18*a* in the unit of control 15*c* is increased stepwise from zero to the application for each turn of the bunch 3, and thus the acceleration voltage value 18*c* equivalent to the ideal acceleration voltage value pattern 18*f* can be provided in a certain time. The group of the equivalent acceleration voltage values 18*c* is referred to as an equivalent acceleration voltage value pattern 18*j*.

For example, when the maximum value of the acceleration voltage value 18*i* required in the nonlinear excitation area 15*a* is 4.7 kV, and the unit of control 15*c* of the acceleration voltage 18*a* is 10 turns, the acceleration voltage value 18*i* can be adjusted stepwise at 0.47 kV intervals from 0 kV to 4.7 kV. Thus, the equivalent acceleration voltage value pattern 18*j* in the nonlinear excitation area 15*a* can be divided into 10 stages. The pulse density 19 at that time is shown in FIG. 7(C).

FIG. 7(C) shows an example of a control method of pulse density 19 when the equivalent acceleration voltage value 18*i* is 0.97 kV in the nonlinear excitation area 15*a*. When the number of turns of the bunch 3 in the unit of control 15*c* is 10, the acceleration voltage 18*a* at the constant value of 4.7 kV is applied at any two turns among the 10 turns.

Specifically, the acceleration voltage 18*a* and the reset voltage 18*b* shown by the solid lines in FIG. 7(C) may be generated. The voltages can be generated by stopping application of induced voltages for acceleration 18*k* and reset voltages 18*l* shown by the dotted lines in real time.

The generation timing of the acceleration voltage 18*a* is thus controlled to apply the voltage of 0.97 kV that is the equivalent acceleration voltage value 18*i*. After the acceleration voltage 18*a*, the reset voltage 18*b* is naturally required.

When an acceleration voltage value 18*i* smaller than 0.47 kV is required, it is only necessary to adjust the ratio of the number of times of application of the acceleration voltage 18*a* to the number of turns of the bunch 3. For example, when an acceleration voltage value 18*i* of 0.093 kV is required, it is only necessary to apply the acceleration voltage 18*a* twice every 100 turns of the bunch 3.

When the nonlinear excitation area 15*a* lasts for 0.1 seconds, a time period for each step with the unit of control 15*c* being set to 10 is 0.01 seconds.

Specifically, the adjustment of the acceleration voltage value 18*c* by controlling the pulse density 19 is allowed by performing control to stop generation of the gate signal pattern 13*a* with the intelligent control device 7 including the digital signal processing device 12 and the pattern generator 13 on the basis of the passage signal 9*a* from the bunch monitor 9.

An acceleration voltage value (Vave) applied to the bunch 3 in the unit of control 15*c* is calculated by the following formula (8) from an acceleration voltage value 18*c* ($V_0$) of a constant value applied by the induction accelerating cell 6, the number of times of application (Non) of the acceleration voltage 18*a* in the unit of control 15*c*, and the number of times of turn-off of the acceleration voltage 18*a* (Noff):

$$Vave = V_0 \cdot Non/(Non + Noff) \qquad \text{Formula (8)}$$

Specifically, the induction accelerating device 5 according to the present invention is used to adjust the pulse density 19 in the unit of control 15*c* by the above described method, and even with the induction accelerating cell 6 that can apply only the acceleration voltage 18*a* of a substantially constant voltage value ($V_0$), the equivalent acceleration voltage value pattern 18*j* corresponding to the ideal acceleration voltage value pattern 18*f* is provided to allow the acceleration voltage 18*a* to be applied to the charged particle beam in synchronization with the magnetic field excitation pattern 15 with slow cycling including the significantly changing nonlinear excitation area 15*a*.

The pulse density 19 may be previously provided to an induced voltage arithmetic unit 22 described later as the equivalent acceleration voltage value pattern 18*j*, or calculated by the induced voltage arithmetic unit 22 in real time.

A time period between the acceleration voltages 18*a* continuously applied (hereinafter referred to as a time duration between pulses 19*a*) is gradually reduced to accommodate a reduction in revolution time of the bunch 3.

Figure 8:
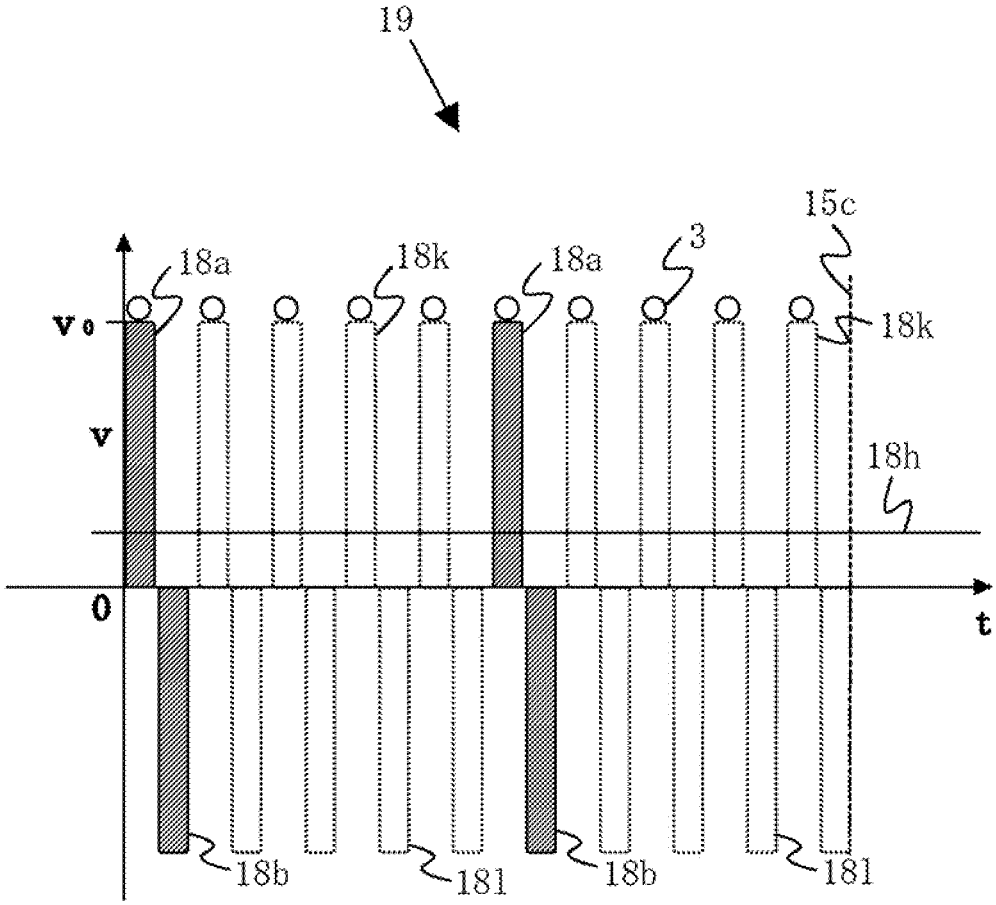
FIG. 8 shows an example of an acceleration method in a linear excitation area of intermittently applying an excessive induced voltage.

FIG. 8 shows an example of an acceleration method in the linear excitation area where an induced voltage of an excessive value is intermittently applied. The axis of abscissa t represents changes with time in the induction accelerating cell 6, and the axis of ordinate v represents the voltage value of the induced voltage 8. $v_0$ represents an induced voltage value applied from the induction accelerating cell 6.

In the pulse density 19 in FIG. 7(A), only the induced voltage for acceleration 18 can be applied, and induced voltages 8 having other functions cannot be applied.

Then, the induction accelerating cell 6 that can apply an excessive induced voltage value in the linear excitation area 15*b* is used to intermittently apply the induced voltage for acceleration 18 even in the linear excitation area 15*b*, rather than apply the induced voltage for acceleration 18 for each turn of the bunch 3. Herein, a method is shown of applying the induced voltage for acceleration 18 with certain continuous 10 turns of the bunch 3 in the linear excitation area 15*b* being the unit of control 15*c*.

In acceleration by the conventional induction accelerating cell for acceleration, the required acceleration voltage value 18*c* may be applied for each turn, while in the acceleration method of a charged particle beam according to the present invention, the barrier voltage 17 also needs to be applied from the induction accelerating cell 6 that applies the induced voltage for acceleration 18, and a time for applying the barrier voltage 17 needs to be ensured.

Thus, the acceleration voltage 18*a* of the excessive acceleration voltage value 18*c* is used even in the linear excitation area 15*b* to ensure the time for applying the barrier voltage 17. It has been found from diligent studies that there is no need for applying the barrier voltage 17 for each turn of the bunch 3.

The number of times of application of the barrier voltage 17 differs depending on the degree of diffusion of the charged particles that constitute the bunch 3, and the acceleration energy level.

The acceleration voltage 18*a* and the reset voltage 18*b* are applied to two turns among the 10 turns from the induction accelerating cell 6 that can apply an acceleration voltage value 18*c* about five times the acceleration voltage value 18*h* in the linear excitation area 15*b*. The application of the induced voltages for acceleration 18*k* and the reset voltages 18*l* shown by the dotted lines is stopped.

In the 10 turns in the unit of control 15*c*, an average acceleration voltage value 18*c* applied to the bunch 3 is substantially equivalent to the acceleration voltage 18*a* required in the linear excitation area 15*b*.

Thus, the induction accelerating cell 6 that can apply an excessive acceleration voltage value 18*c* is used even in the linear excitation area 15*b*, thereby eliminating the need for applying the induced voltage for acceleration 18 for each turn of the bunch 3, and ensuring the time for applying the induced voltages 8 having other functions.

Figure 9:
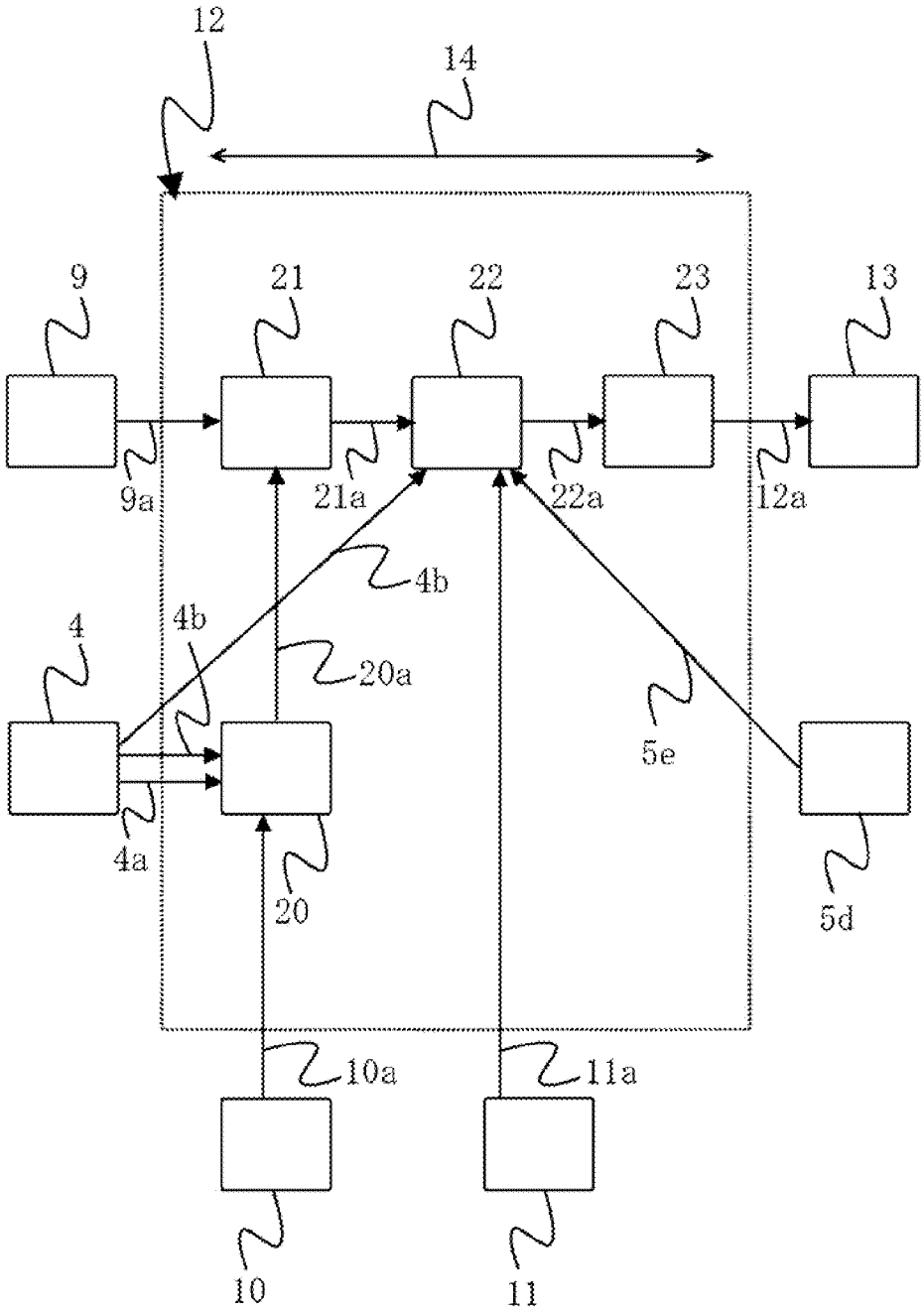
FIG. 9 is a block diagram of a digital signal processing device.

FIG. 9 is a block diagram of the digital signal processing device. The digital signal processing device 12 includes a variable delay time calculator 20, a variable delay time generator 21, an induced voltage arithmetic unit 22, and a gate master signal output device 23.

The variable delay time calculator 20 determines the variable delay time 14. Definition formulas of the variable delay time 14 calculated on the basis of information on the kind of charged particles and the magnetic field excitation patterns 15 and 24 are provided to the variable delay time calculator 20, which are a series of formulas (1) to (6) for calculating the variable delay time 14 described above, or the required variable delay time pattern 14*b*.

The information on the kind of charged particles is the mass and the charge state of the accelerated charged particles. Energy obtained by the charged particles from the induced voltage 8 is proportional to the charge state, and the speed of the charged particles thus obtained depends on the mass of the charged particles. Since changes in the variable delay time 14 depend on the speed of the charged particles, the information is previously provided.

The variable delay time generator 21 is a counter using a certain frequency as a reference, and keeps the passage signal 9*a* from the bunch monitor 9 in the digital signal processing device 12 for a certain time period and then causes the passage signal 9*a* to pass through. For example, with a counter of 1 kHz, the numerical value of 1000 of the counter is equal to 1 sec. Specifically, a numerical value corresponding to the variable delay time 14 can be input to the variable delay time generator 21 to control the length of the variable delay time 14.

Specifically, the variable delay time generator 21 performs control to stop generation of the gate master signal 12*a* for a time period corresponding to the variable delay time 14 on the basis of the variable delay time signal 20*a* that is output by the variable delay time calculator 20 and is a value corresponding to the variable delay time 14.

This allows the generation timing of the induced voltage 8 to match with the time when the bunch 3 arrives at the induction accelerating cell 6 or the time when no bunch 3 exists in the induction accelerating cell 6, and also allows an arbitrary time to be selected.

For example, if the variable delay time calculator 20 outputs a variable delay time signal 20*a* of the numerical value of 150 is output to the variable delay time generator 21 that is the counter of 1 kHz, the variable delay time generator 21 performs control to delay generation of a pulse 21*a* for 0.15 sec.

The variable delay time generator 21 receives the passage signal 9*a* from the bunch monitor 9 and the variable delay time signal 20*a* from the variable delay time calculator 20 to calculate timing for generating the next induced voltage 8 for each bunch 3 having passed through the bunch monitor 9, and outputs the pulse 21*a* that is information on the variable delay time 14 to the induced voltage arithmetic unit 22.

The passage signal 9*a* is a pulse generated at an instant of the passage of the bunch 3 through the bunch monitor 9. The pulse includes a voltage pulse, a current pulse, a light pulse, or the like having appropriate strength according to the kinds of media or cables that transmit the pulse. The bunch monitor 9 for obtaining the passage signal 9*a* may be a monitor for detecting passage of charged particles conventionally used in an rf synchrotron.

The passage signal 9*a* is used for providing passage timing of the bunch 3 as time information to the digital signal processing device 12. A position of the bunch 3 on the design orbit 2 in the advancing axis direction 3*a* is calculated by a leading edge of the pulse generated by the passage of the bunch 3. Specifically, the passage signal 9*a* is a reference of a start time of the variable delay time 14.

The induced voltage arithmetic unit 22 determines the kind of the induced voltage 8 and whether the induced voltage 8 is generated (on) or not (off).

For example, when a negative barrier voltage value 17*c* (positive barrier voltage value 17*d*) required at a certain instant is −0.5 kV (0.5 kV), the induced voltage arithmetic unit 22 determines whether a pulse 22*a* is generated (1) or not (0).

Using the negative barrier voltage 17*a* (positive barrier voltage 17*b*) of a constant value of −1.0 kV (1.0 kV), the induced voltage arithmetic unit 22 represents whether the negative barrier voltage 17*a* (or positive barrier voltage 17*b*) is applied or not as [1, 0, . . . , 1] every 10 turns of the bunch 3.

If the induced voltage arithmetic unit 22 represents 1 five times and 0 five times, an average negative barrier voltage value (positive barrier voltage value) received by the bunch 3 during 10 turns is −0.5 kV (0.5 kV). Thus, the induced voltage arithmetic unit 22 can digitally control the induced voltage 8.

For example, when the negative barrier voltage value 17*c* (positive barrier voltage value 17*d*) is changed from 0 V to −1 kV (1 kV) in 1 sec and controlled at 0.1 sec intervals, an equivalent barrier voltage value pattern is a data table with such as 0 kV for 0.1 sec from the start of acceleration, −0.1 kV (0.1 kV) for 0.1 to 0.2 sec, −0.2 kV (0.2 kV) for 0.2 to 0.3 . . . −1.0 kV (1.0 kV) for 0.9 to 1.0 sec.

When the unit of control is n turns, and the acceleration voltage 18*a* is applied to the charged particle beam m times during the n turns, an equivalent acceleration voltage value received by the charged particle beam in the unit of control 15*c* is m/n times the acceleration voltage value 18*c* output by the induction accelerating cell 6.

It is clear that m is always smaller than n. This condition is met when the unit of control 15*c* is sufficiently shorter than the speed of change of the orbit of the charged particle beam. The unit of control 15*c* can be freely selected within a range from a lower limit where the unit of control 15*c* is reduced to reduce voltage accuracy to prevent an appropriate voltage from being applied and an upper limit where the unit of control 15*c* is increased to prevent response to the change of the orbit.

The voltage value of the induced voltage 8 required for a certain time can be calculated in real time for each turn of the bunch 3. When the voltage value of the induced voltage 8 required for a certain time is calculated in real time, it is only necessary that magnetic field strength at the time is received as a beam deflection magnetic field strength signal 4*b* from the bending magnet 4 that constitutes the synchrotron 1 using the induction accelerating cell 6, and the voltage value is calculated by a calculation formula similar to that in the case of previous calculation.

The pulse 22*a* that is determined on the basis of the voltage value of the induced voltage 8 required for a certain time during acceleration provided as described above and controls generation of the gate master signal 12*a* is output to the gate master signal output device 23.

The gate master signal output device 23 generates a pulse for transmitting the pulse 22*a* containing information on the variable delay time 14 of passage through the digital signal processing device 12 and on/of of the barrier voltage 17 to the pattern generator 13, that is, the gate master signal 12*a*.

The leading edge of the pulse that is the gate master signal 12*a* output from the gate master signal output device 23 is used as generation timing of the barrier voltage 17. The gate master signal output device 23 converts the pulse 22*a* output from the induced voltage arithmetic unit 22 into a voltage pulse, a current pulse, a light pulse, or the like having appropriate pulse strength according to the kinds of media or cables that transmit the pulse to the pattern generator 13.

Like the passage signal 9*a*, the gate master signal 12*a* is a rectangular voltage pulse output from the gate master signal output device 23 at the instant of the passage of the variable delay time 14 for generating the appropriate induced voltage 8 on the basis of the passage of the bunch 3. The pattern generator 13 recognizes the leading edge of the pulse that is the gate master signal 12*a* to start the operation.

The digital signal processing device 12 as described above outputs the gate master signal 12*a* that becomes the basis of the gate signal pattern 13*a* that controls driving of the switching power supply 5*b* to the pattern generator 13 on the basis of the passage signal 9*a* from the bunch monitor 9 on the design orbit 2 along which the bunch 3 circulates. Specifically, the digital signal processing device 12 controls on/off the induced voltage 8.

The variable delay time 14 and the voltage value and the charging time period of the induced voltage 8 are calculated in real time to allow the induced voltage 8 synchronized with the revolution frequency of the bunch 3 to be applied according to the magnetic field excitation pattern 15 of the synchrotron 1 using the induction accelerating cell 6 without changing setting.

When the variable delay time 14 is previously calculated, the passage of the bunch 3 and the generation timing of the induced voltage 8 can be always matched with each other simply by replacing the required variable delay time pattern 14*b* corresponding to the ideal variable delay time pattern 14*a* in the variable delay time calculator 20 and the equivalent acceleration voltage value pattern 18*j* in the induced voltage arithmetic unit 22 with calculation results according to the selected charged particles and magnetic field excitation patterns.

Figure 10:
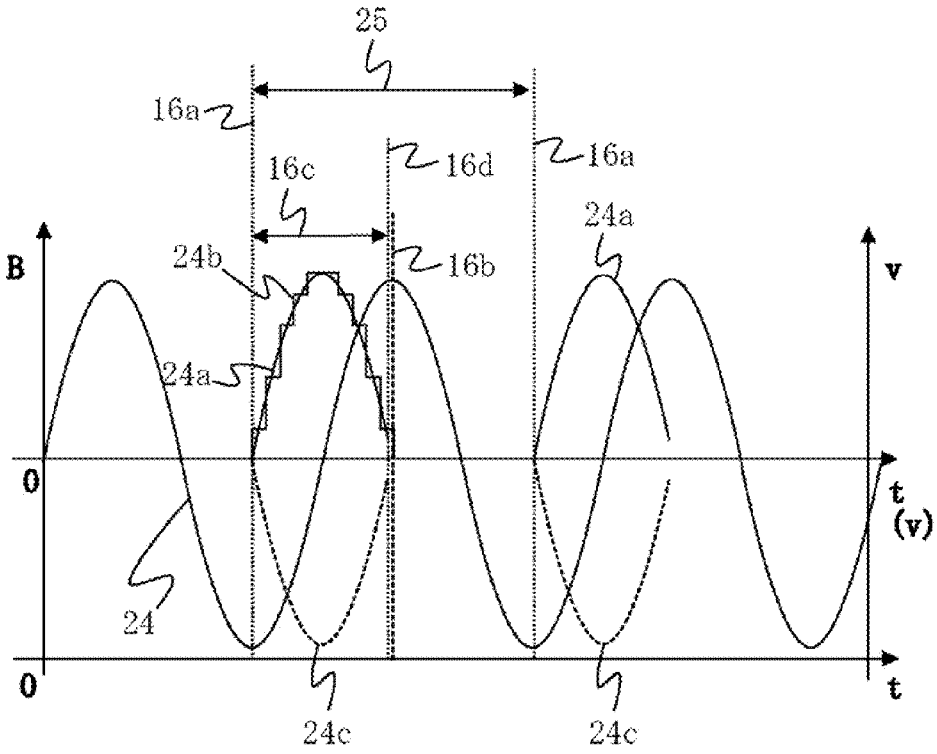
FIG. 10 shows a relationship between a rapid cycling and the acceleration voltage.

FIG. 10 shows a relationship between rapid cycling and the acceleration voltage. The operation scheme of the synchrotron 1 includes a rapid cycling scheme and a slow cycling scheme. The schemes include magnetic field excitation patterns 15 and 24 temporally changing in the process of accelerating the charged particle beam.

It has been described that the acceleration voltage 18*a* of a constant value can be used to accelerate arbitrary charged particles up to an arbitrary energy level in synchronization with the slow cycling magnetic field excitation pattern 15. However, according to the induction accelerating device 5 and the control method thereof of the present invention, the induced voltage for acceleration 18 may be synchronized with the slow cycling magnetic field excitation pattern 24.

The rapid cycling refers to acceleration by the magnetic field excitation pattern 24 with rapid cycling of one cycle 25 of about several ten milliseconds, one cycle starting from a time when the charged particles are injected 16*a* from the preinjector, and going through an acceleration time 16*c* and extraction 16*b* to the next injection 16*a*.

The first axis of ordinate B in FIG. 10 represents magnetic field strength of the synchrotron 1 using the induction accelerating cell 6, and the second axis of ordinate v represents the voltage value of the induced voltage for acceleration 18. The first axis of abscissa t represents changes with time of the magnetic field excitation pattern 24, and the second axis of abscissa t (v) represents the generation time of the induced voltage for acceleration 18, and both refer to the time when the charged particle beam is injected 16*a* into the synchrotron 1 using the induction accelerating cell 6.

The rapid cycling magnetic field excitation pattern 24 has the amplitude of a sine curve, and the voltage value of the induced voltage for acceleration 18 synchronized with the magnetic field excitation pattern 24 is calculated by the above described formula (7) as in the method of the calculation from the slow cycling magnetic field excitation pattern 15.

The group of acceleration voltage values 18*c* calculated by the formula (7) is an ideal acceleration voltage value pattern 24*a*. The ideal acceleration voltage value pattern 24*a* is proportional to time differential of magnetic field changes in a certain time of the magnetic field excitation pattern 24, and thus changes of the acceleration voltage value 18*c* of a cosine curve is theoretically calculated.

Naturally, a reset voltage 18*b* equivalent to an ideal reset voltage value pattern 24*c* in a direction opposite to an ideal acceleration voltage value pattern 24*a* must be generated in a time period without the charged particle beam.

To apply the acceleration voltage 18*a* in synchronization with the magnetic field excitation pattern 24, a required acceleration voltage value 18*c* significantly increases or decreases with time as compared with the case of the slow cycling magnetic field excitation pattern 15.

However, according to the induction accelerating device 5 and the control method thereof of the present invention, the equivalent acceleration voltage value pattern 24*b* can be used to accurately control the acceleration voltage 18*a* at high speed in synchronization with the rapid cycling magnetic field excitation pattern 24 with complex changes of the acceleration voltage value 18*c*.

Thus, in all magnetic field excitation patterns, the induction accelerating device 5 and the control method thereof of the present invention can be used to accelerate arbitrary charged particles up to an arbitrary energy level.

Figure 11:
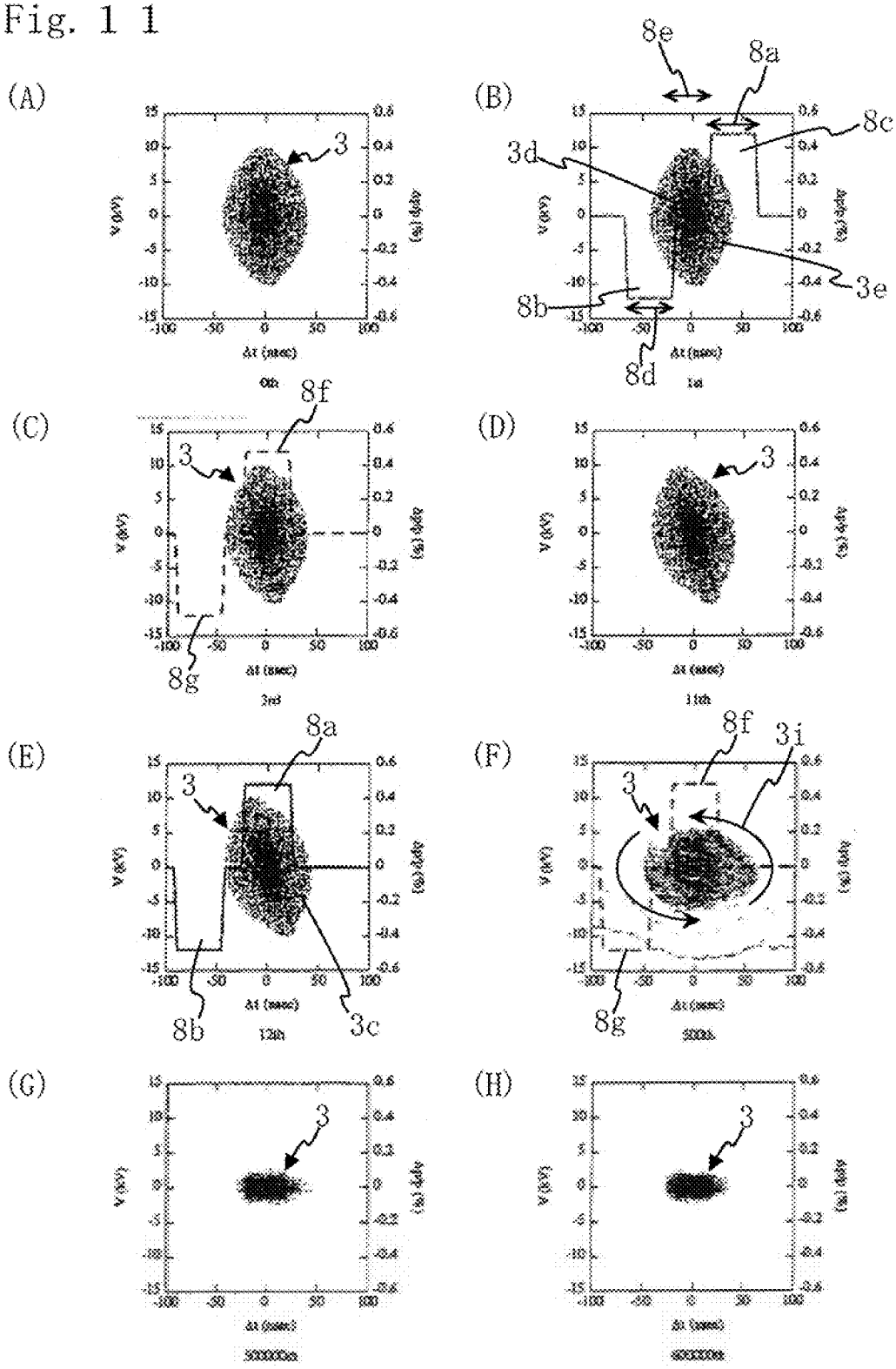
FIG. 11 shows an example (simulation) of an acceleration method of a charged particle beam according to the present invention.

FIG. 11 shows an example (simulation) of the acceleration method of a charged particle beam according to the present invention. Acceleration behavior in acceleration of 10,000 charged particles (protons) up to an energy level of 40 to 500 MeV is shown. In the simulation, the following conditions were adopted.

A small-sized synchrotron (500 MeV booster synchrotron) for an injector of 12 GeVPS was supposed and a peripheral length of a vacuum duct 2*a* thereof was used. For the digital signal processing device 12 that constitutes the induction accelerating device 5 according to the present invention, it was supposed that the variable delay time 14 was preset and the induced voltage 8 was supplied at an instant of passage of the bunch 3 through the induction accelerating cell 6.

The induced voltage arithmetic unit 22 previously stored the generation pattern (intermittent application) of the induced voltage 8, and a method of stopping the positive induced voltage 8*a* that functions as an unnecessary induced voltage for acceleration 18 was used so as to reduce deviation between "ideal energy of the charged particle beam determined from the magnetic field excitation pattern" and "energy of the charged particle beam in intermittent acceleration by the induced voltage".

Charging time periods 8*c* and 8*d* of the induced voltage 8 were 52 nsec, voltage amplitudes of the negative induced voltage 8*b* and the positive induced voltage 8*a* were 12 kV, and a time duration between generations 8*e* of the negative induced voltage 8*b* and the positive induced voltage 8*a* were fixed at 15 nsec.

The rectangular pulse shape of the induced voltage 8 was the same during acceleration without being changed with time. From a restriction on an operation frequency of the switching power supply 5*b* (being 1 MHz or less), after the pair of negative induced voltage 8*b* and positive induced voltage 8*a* were generated, at least a 1 μsec rest was necessary before the next pair of negative induced voltage 8*b* and positive induced voltage 8*a* were generated.

For the magnetic field excitation pattern, the linear excitation area 15*b* of the slow cycling magnetic field excitation pattern 15 that requires a constant acceleration voltage value 18*c* of 0.5 kV/turn was supposed in the 500 MeV booster synchrotron. At this time, the revolution frequency of the charged particle is 2 to 6 MHz, which is higher than the operation frequency of 1 MHz of the switching power supply 5*b*, and sharply changes.

The axis of abscissa Δt (nsec) in FIGS. 11(A) to (H) represents a deviation (time) of charged particles from design particles when the design particles are indicated by 0. The unit of time is nanosecond. Thus, FIGS. 11(A) to (H) show degrees of variations of the bunch 3 with respect to the design particles during acceleration.

The first axis of ordinate V (kV) represents the voltage value of the induced voltage 8. The second axis of ordinate Δp/p (%) represents a momentum deviation, which corresponds to a deviation of energy of the charged particles. FIG. 11(A) to (H) show part of turns from the 0th turn (FIG. 11(A)) immediately after the injection 16*a* to the 600,000th turn (FIG. 11(H)). The number of turns is indicated under each axis of abscissa Δt (nsec).

FIG. 11(A) shows a state where the charged particles accelerated up to 40 MeV by the preinjector are injected 16*a* into the vacuum duct 2*a*, circulate along the design orbit 2, and form the bunch 3.

FIG. 11(B) shows a state of the bunch 3 in the 1st turn. The induced voltage 8 is first applied to the bunch 3 circulating along the design orbit 2, and the negative induced voltage 8*b* is applied to the bunch head 3*d* and the positive induced voltage 8*a* is applied to the bunch tail 3*e*. Thus, it can be seen that the negative and positive induced voltages 8*b* and 8*a* function as the negative and positive barrier voltages 17*a* and 17*b* for confinement of the bunch 3.

FIG. 11(C) shows a state of the bunch 3 in the 3rd turn. Timing for applying the positive induced voltage 8*f* and the negative induced voltage 8*g* is shown by the dotted lines, but the application thereof is stopped. The 3rd turn is the generation timing of the set induced voltage 8 described above, but the generation of the induced voltage 8 is stopped because the energy level of the charged particle beam is excessive with respect to the required acceleration voltage value 18*i* calculated from the magnetic field excitation pattern 24. Stopping the application of the positive and negative induced voltages 8*a* and 8*b* is actually determined by the induced voltage arithmetic unit 22 that constitutes the digital signal processing device 12.

FIG. 11(D) shows a state of the bunch 3 in the 11th turn. Neither of the positive and negative induced voltages 8*a* and 8*b* are not applied. Even if the positive and negative induced voltages 8*a* and 8*b* that function as the barrier voltages 17 are not applied, a time period without the application of the positive and negative induced voltages 8*a* and 8*b* is within an acceptable range, and thus the bunch 3 is confined without diffusion. Also, even if the positive induced voltage 8*a* that functions as the acceleration voltage 18*a* is not applied, a time period without the application of the positive induced voltage 8*a* is within an acceptable range, and thus the bunch 3 is synchronized with the magnetic field excitation pattern 24. Thus, it can be seen that the charged particle beam can be accelerated by intermittently applying the induced voltage 8.

FIG. 11(E) shows a state of the bunch 3 in the 12th turn. Herein, the positive induced voltage 8*a* is applied to the entire bunch mainly including the bunch center 3*c*, and thus functions as the acceleration voltage 18*a*. Thus, the negative induced voltage 8*b* functions as the reset voltage 18*b*.

FIG. 11(F) shows a state of the bunch 3 in the 500th turn. The application of the positive induced voltage 8*f* and the negative induced voltage 8*g* shown by the dotted lines is stopped. The 500th turn is generation timing of the positive and negative induced voltages 8*a* and 8*b*, but the application is stopped as in FIG. 11(C). The bunch 3 that is vertically long in FIG. 11(A) is deformed to be horizontally long in FIG. 11(F), and thus the synchrotron oscillation 3*i* can be confirmed by the intermittent application of the induced voltage 8 in the process. The deformation is mainly caused by adiabatic damping, but influenced by slight leakage from the confinement area of the charged particles.

FIG. 11(G) shows a state of the bunch 3 in the 500,000th turn, and FIG. 11(H) shows a state of the bunch 3 in the 600,000th turn. In both the drawings, it can be seen that the bunch 3 with a high density on the orbit close to the design particles is accelerated.

The acceleration method of a charged particle beam according to the present invention for intermittently applying the induced voltage 8 to the bunch 3 also allows the confinement of the bunch 3, the acceleration of the bunch 3 in synchronization with the magnetic field excitation pattern 24, the control of the synchrotron oscillation frequency, and the control of the beam orbit, thereby allowing the charged particle beam to be accelerated up to an arbitrary energy level.

The beam orbit control refers to controlling the generation timing of the induced voltage 8 to maintain the charged particle beam on the design orbit 2.

The synchrotron 1 maintains the bunch 3 on the design orbit 2 with the magnetic field strength by the bending magnet 4 that constitutes the synchrotron 1. The orbit of the charged particle beam is the design orbit 2 that is placed around a point outside or inside the center of the vacuum duct 2*a*, which is determined by arrangement of the bending magnet 4 that constitutes the synchrotron 1, rather than placed around the center of the vacuum duct 2*a*.

Without the magnetic field strength by the bending magnet 4, the bunch 3 would collide with a wall surface of the vacuum duct 2*a* with a centrifugal force of the charged particle beam and be lost. The magnetic field strength changes with the acceleration time 16*c*. The changes are the magnetic field excitation patterns 15 and 24.

Once the kind of charged particles to be accelerated, an acceleration energy level, and a peripheral length of the synchrotron 1 are determined, a revolution frequency band width of the charged particle beam is uniquely determined. Thus, like the rf acceleration voltage, the induced voltage 8 that functions as the induced voltage for acceleration 18 must be applied to the charged particle beam for acceleration in the advancing axis direction 3*a* in synchronization with the magnetic field excitation patterns 15 and 24.

However, the voltage value of the induced voltage 8 applied to the bunch 3 is not constant but slightly increases or decreases. This is because of various factors such as deviation of the charging voltage of the bank capacitor 5*f* from an ideal value.

When an acceleration voltage value 18*c* lower than the ideal acceleration voltage value 18*c* is actually applied because of the synchronization with the magnetic field excitation patterns 15 and 24, the bunch 3 is displaced inward from the design orbit 2. On the other hand, when an acceleration voltage value 18*c* higher than the ideal acceleration voltage value 18*c* is actually applied, the charged particle beam is displaced outward from the design orbit 2.

It is supposed that a method of correcting the charged particle beam along the design orbit 2 includes changing the level of the acceleration voltage value 18*c*. However, the induction accelerating device 5 that generates the acceleration voltage value 18*c* must include a large bank capacitor 5*f* (capacitance) in a high pressure charging unit of the switching power supply 5*b* that determines the amplitude of the pulse voltage 6*f* for obtaining stable output electric power of some ten kW required by the induction accelerating cell 6.

A charging pressure of the bank capacitor 5*f* is intended for stable output of the pulse voltage 6*f*, and cannot change at high speed. Thus, the amplitude of the pulse voltage 6*f* cannot be actually controlled at high speed.

Thus, when the DC power supply 5*c* and the bank capacitor 5*f* to use are determined, the output voltage is uniquely determined, and thus the voltage value cannot be significantly changed in a short time period. Thus, in the method of changing the amplitude of the pulse voltage 6*f*, the induced voltage 8 cannot be synchronized with the magnetic field excitation patterns 15 and 24.

Without eliminating the above described deviation of the voltage value of the induced voltage 8, once the charged particle beam receives the acceleration voltage value 18*c* higher than the required acceleration voltage value 18*c* in the synchrotron 1 using the induction accelerating cell 6, the charged particle beam is displaced outward from the design orbit 2 by the centrifugal force of the charged particle beam and cannot be accelerated.

Thus, to solve the above described problem, the pulse density 19 is corrected in real time in the unit of control 15*c*, and the positive induced voltage 8*a* that functions as the acceleration voltage 18*a* is applied to the charged particle beam on the basis of the corrected pulse density 19, thereby correcting the displacement of the orbit of the charged particle beam.

Specifically, in the slow cycling synchrotron 1, an orbit control method of the charged particle beam using the digital signal processing device in FIG. 9 will be described. For the variable delay time 14, a required variable delay time pattern 14*b* is previously calculated and stored in the variable delay time calculator 20.

The variable delay time calculator 20 generates the variable delay time signal 20*a* corresponding to the variable delay time 14 on the basis of the required variable delay time pattern 14*b*, and the variable delay time generator 21 receives the passage signal 9*a* of the bunch 3 from the bunch monitor 9 on the design orbit 2 along which the charged particle beam circulates and the variable delay time signal 20*a* from the variable delay time calculator 20 to generate the pulse 21*a* corresponding to the variable delay time 14.

The induced voltage arithmetic unit 22 that stores the equivalent acceleration voltage value pattern 18*j* corresponding to the ideal acceleration voltage value pattern 18*f* calculated on the basis of the magnetic field excitation pattern 15, and generates the pulse 22*a* for controlling on/off the induced voltage 8 that functions as the induced voltage for acceleration 18 receives the pulse 21*a* corresponding to the variable delay time 14 from the variable delay time generator 21 and a position signal 11*a* from the position monitor 11 that detects the displacement of the charged particle beam on the design orbit 2 from the design orbit 2 to stop application of the excessive induced voltage for acceleration 18 from the pulse density 19 in the unit of control 15*c*.

The gate master signal output device 23 receives the pulse 22*a* that is on/off information of the induced voltage 8 calculated by the induced voltage arithmetic unit 22 to generate the gate master signal 12*a* that is a pulse suitable for the pattern generator 13.

The gate master signal 12*a* thus calculated by the digital signal processing device 12 is converted into the gate signal pattern 13*a* that is the combination of on and off of the current path of the switching power supply 5*b* by the pattern generator 13. In this manner, on/off of the induced voltage 8 is controlled to stop application of the excessive induced voltage 8.

To stop the excessive induced voltage 8, the bunch monitor 9 for checking the passage of the bunch 3, the speed monitor 10 for measuring the acceleration speed of the bunch 3 in real time, and the position monitor 11 for detecting the degree of displacement of the charged particle beam horizontally inward or outward from the design orbit 2.

The bending magnet 4 has a structure in which a conductor is wound around an iron core or an air core like a coil, and a current is passed through the conductor to generate magnetic field strength perpendicular to the advancing axis of the charged particle beam. Since the magnetic field strength of the bending magnet 4 is proportional to the current passing through the conductor, the proportional coefficient is previously calculated, and a current rate is measured and converted to calculate the magnetic field strength.

The speed monitor 10 generates a voltage value, a current value, or a digital value according to a revolution speed of the bunch 3. The speed monitor 10 includes one having an analogue structure in which voltage pulses or current pulses generated in the passage of the charged particle beam are accumulated in a capacitor and converted into a voltage value like the bunch monitor 9, and one having a digital structure in which the number of the voltage pulses is counted by a digital circuit.

The position monitor 11 outputs a voltage value proportional to the displacement of the bunch 3 from the design orbit 2. The position monitor 11 includes, for example, two conductors each having a slit slanting in the advancing axis direction 3*a*, and charges are induced in a conductor surface with the passage of the bunch 3. Since the amount of induced charges depends on the position between the bunch 3 and the conductor, the amount of charges induced in the two conductors differs depending on the position of the bunch 3, and thus there is a difference between the voltage values induced in the two conductors.

For example, when the bunch 3 passes through the center of the position monitor 11, equal voltages are induced, and an output voltage value of a difference between the voltages generated in the two conductors is 0. When the bunch 3 passes through outside the design orbit 2, a positive voltage value proportional to the displacement from the center is output, and when the bunch 3 passes through inside the design orbit 2, a negative voltage value proportional to the displacement from the center is output.

Thus, the bending magnet 4, the bunch monitor 9, the speed monitor 10, and the position monitor 11 used in acceleration of the rf synchrotron can be used.

Signals used for controlling the generation timing of the induced voltage for acceleration 18 includes a cycle signal 4*a* output from the bending magnet 4 (via the control device of the accelerator) at the instant of injection of the charged particle beam from the preinjector, the beam deflection magnetic field strength signal 4*b* that is the magnetic field excitation pattern in real time, the passage signal 9*a* from the bunch monitor 9 that is information on the passage of the charged particle beam through the bunch monitor 9, a speed signal 10*a* indicating a revolution speed of the bunch 3, and a position signal 11*a* from the position monitor 11 that is information on the displacement of the circulating charged particle beam from the design orbit 2.

The variable delay time 14 can be previously calculated and provided as the required variable delay time pattern 14*b* when the kind of the charged particles and the magnetic field excitation pattern are previously determined.

However, when the variable delay time 14 is previously calculated, the orbit of the charged particle beam cannot be corrected if the charged particle beam is displaced inward or outward from the design orbit 2. Thus, when the variable delay time 14 is previously calculated, the induced voltage arithmetic unit 22 corrects the positive induced voltage 8*a* that functions as the induced voltage for acceleration 18.

If the speed monitor 10 for measuring the revolution speed of the charged particle beam is used, and the speed signal 10*a* that is the revolution speed of the charged particle beam is input to the variable delay time calculator 20 in real time, the variable delay time 14 can be calculated in real time by the formulas (1) and (2) without providing information on the kind of the charged particles.

The variable delay time 14 is calculated in real time to allow the orbit of the charged particle beam to be corrected by correcting the generation timing of the induced voltage 8 if the applied acceleration voltage value 18*c* is changed from a predetermined set value by the DC power supply 5*c*, the bank capacitor 5*f*, or the like that constitute the induction accelerating device 5, and some disturbance causes a sudden change in the revolution speed of the bunch 3.

To the variable delay time calculator 20, the cycle signal 4*a* is input from the bending magnet 4 (via the control device of the accelerator). The cycle signal 4*a* is a pulse voltage generated from the bending magnet 4 (via the control device of the accelerator) when the charged particle beam is injected into the synchrotron 1, and information on the start of acceleration. Generally, the synchrotron 1 repeats the injection 16*a*, the acceleration, and the extraction 16*b* of the charged particle beam multiple times.

Thus, when the variable delay time 14 is previously started, the variable delay time calculator 20 receives the cycle signal 4*a* indicating the start of acceleration, and outputs the variable delay time signal 20*a* to the variable delay time generator 21 on the basis of the previously calculated variable delay time 14.

As described above, to correct the orbit of the charged particle beam displaced from the design orbit 2 because of the nonconstant voltage value of the induced voltage 8 and sudden trouble during acceleration, it is necessary to stop the generation of the induced voltage 8, that is, to change the pulse density 19.

For the induced voltage arithmetic unit 22 to correct the orbit of the charged particle beam, information on how far the orbit of the charged particle beam is displaced outward from the design orbit 2 by how much acceleration voltage value 18*c* is supplied to the charged particle beam needs to be previously provided to the acceleration voltage arithmetic unit 16 as basic data for correction.

Next, the induced voltage arithmetic unit 22 receives the amount of displacement of the charged particle beam from the design orbit 2 as the position signal 11*a* from the position monitor 11 on the design orbit 2 at a time point during the acceleration, and performs calculation for correcting the orbit of the charged particle beam in real time for each turn of the bunch 3.

An acceleration voltage per one turn required for correcting the orbit of the charged particle beam at the number of turns n in the unit of control is approximately calculated by the following formula (9):

$$V=C_0\times(B'\times\rho+B\times\rho') \qquad \text{Formula (9)}$$

where ρ is a present orbit radius, ρ' is time differential thereof, B is magnetic field strength, B' is time differential thereof, and $C_0$ is the entire length of the synchrotron.

The value V is an average acceleration voltage value applied by the induction accelerating cell 6 in the unit of control 15*c*. Naturally, the right side of the formula (9) can be expanded to an arbitrary formula expressed by a numerical calculation formula obtained from modern control theory or the like.

$$V=(m/n)Vacc(m<n) \qquad \text{Formula (10)}$$

where Vacc is an ideal acceleration voltage value calculated by the formula (7).

The values ρ' and B' are calculated by the following formulas (11) and (12):

$$\rho'=\Delta\rho/(\Sigma t) \qquad \text{Formula (11)}$$

$$B'=\Delta B/(\Sigma t) \qquad \text{Formula (12)}$$

where t is a revolution time of the bunch 3 per one turn, Δρ is an orbit radius in the unit of control, ΔB is a change in magnetic field strength in the unit of control 15*c*, and Σt is a total time of t added for the number of turns n. When the induced voltage 8 is controlled in real time, ρ' and B' are calculated by the induced voltage arithmetic unit 22.

The revolution time t of the bunch 3 per one turn is calculated by the following formula (13):

$$t=C_0/v \qquad \text{Formula (13)}$$

where v is the revolution speed obtained from the speed monitor 10 or the like and $C_0$ is the entire length of the synchrotron. The value t is different for each turn of the bunch 3.

On the basis of the calculation results of the acceleration voltage value obtained from these processes, a required induced voltage 8 is applied, or application of the positive induced voltage 8*a* that functions as the induced voltage for acceleration 18 corresponding to the excessive acceleration voltage value is stopped. Stopping the application of the positive induced voltage 8*a* means that generation to be performed next of the positive induced voltage 8*a* that functions as the acceleration voltage 18*a* is not performed.

The orbit of the charged particle beam is displaced outward from the design orbit 2 because the acceleration voltage value 18*c* applied to the charged particle beam is more excessive than the acceleration voltage value 18*c* required at the instant to prevent synchronization with the magnetic field excitation pattern of the bending magnet 4.

Thus, the excessive acceleration voltage value is calculated from the equivalent acceleration voltage value pattern 18*j* calculated previously or in real time from the magnetic field excitation pattern 15, and the displacement of the orbit obtained from the position signal 11*a*, and the pulse density is corrected by subtracting the excessive acceleration voltage value from the previously provided equivalent acceleration voltage value pattern 18*j*.

Correcting the pulse density 19 means stopping the application of the positive induced voltage 8*a* that functions as the acceleration voltage 18*a* corresponding to the excess of the acceleration voltage value in the acceleration voltage value 18*c* previously provided and required at the instant and the pulse density 19 in the unit of control 15*c*.

Besides the previously provided equivalent acceleration voltage value pattern 18*j*, for example, when the charged particle beam is even slightly displaced outward from the design orbit 2, it is allowed that pulse densities 19 for correcting the orbit of the charged particle beam for "significant correction" or "gentle correction" are previously provided, and a required pulse density 19 is selected to control the orbit of the charged particle beam.

Alternatively, the orbit of the charged particle beam may be maintained on the design orbit 2 by replacing the pulse density 19 in the unit of control 15*c* in a certain time of the equivalent acceleration voltage value pattern 18*j* with another pulse density 19 stored in the induced voltage arithmetic unit 22.

When on/off of the variable delay time 14 and the induced voltage 8 is controlled in real time, the induced voltage 8 is controlled for each turn of the bunch 3 to position the orbit of the charged particle beam on the design orbit 2.

The above described control method is used to allow appropriate orbit control in changes of the orbit of the charged particle beam that differs depending on the size of the accelerator.

The magnetic field excitation pattern 15, the equivalent acceleration voltage value pattern 18*j*, the basic data for correction, and the pulse density 19 for correction are replaceable data, and can be changed according to the kind of selected charged particles or the magnetic field excitation pattern.

By simply replacing the data, the induction accelerating device 5 according to the present invention can be used for accelerating arbitrary charged particles up to an arbitrary energy level.

Controlling the orbit of the charged particle beam requires calculation of the acceleration voltage value 18*c* required in a certain time for each turn of the bunch 3 in real time. When the acceleration voltage value 18*c* required in a certain time is calculated in real time, it is only necessary to receive the magnetic field strength at that time as the beam deflection magnetic field strength signal 4*b* from the bending magnet 4 (via the control device of the accelerator) that constitutes the synchrotron 1 using the induction accelerating cell 6, and calculate the acceleration voltage value 18*c* by a calculation formula as in the case of previous calculation.

The induced voltage signal 5*e* that is the voltage value of the induced voltage 8 obtained from the induced voltage monitor 5*d* that is the ammeter in FIG. 9 may be fed back to the induced voltage arithmetic unit 22 of the digital signal processing device 12 to calculate the equivalent acceleration voltage value pattern 18*j* corresponding to the ideal acceleration voltage value pattern 18*f*.

The position monitor 11 and the induced voltage monitor 5*d* are concurrently used to check the displacement of the orbit of the charged particle beam more accurately, thereby allowing more accurate control of the orbit of the charged particle beam.

Thus, the induced voltage arithmetic unit 22 has the function of measuring the acceleration voltage value required for correcting the orbit of the charged particle beam in real time, and intermittently outputting the pulse 22*a* for correcting the pulse density 19 based on the equivalent acceleration voltage value pattern 18*j* previously provided to the induced voltage arithmetic unit 22 rather than simply outputting the acceleration voltage 18*a* for each turn of the bunch 3 using the passage signal 9*a* sent from the bunch monitor 9.

Thus, the induction accelerating device 5 according to the present invention is used to control the variable delay time 14 and the pulse density 19 of the induced voltage 8 that functions as the induced voltage for acceleration 18, thereby allowing the charged particle beam to be maintained on the design orbit 2 without being displaced therefrom for all magnetic field excitation patterns even by the induction accelerating cell 6 that can apply only the acceleration voltage 18*a* of a substantially constant voltage value ($V_0$) to the design orbit 2.

The generation timing of the induced voltage 8 is controlled in real time by the induction accelerating device 5 according to the present invention to correct the pulse density in real time, and correct the displacement of the orbit of the charged particle beam in synchronization with all synchrotron operation schemes, that is, all magnetic field excitation patterns so that the charged particle beam is positioned on the original design orbit 2.

Also, the charged particle beam may be circulated along an arbitrary orbit inside or outside the design orbit 2.

Figure 12:
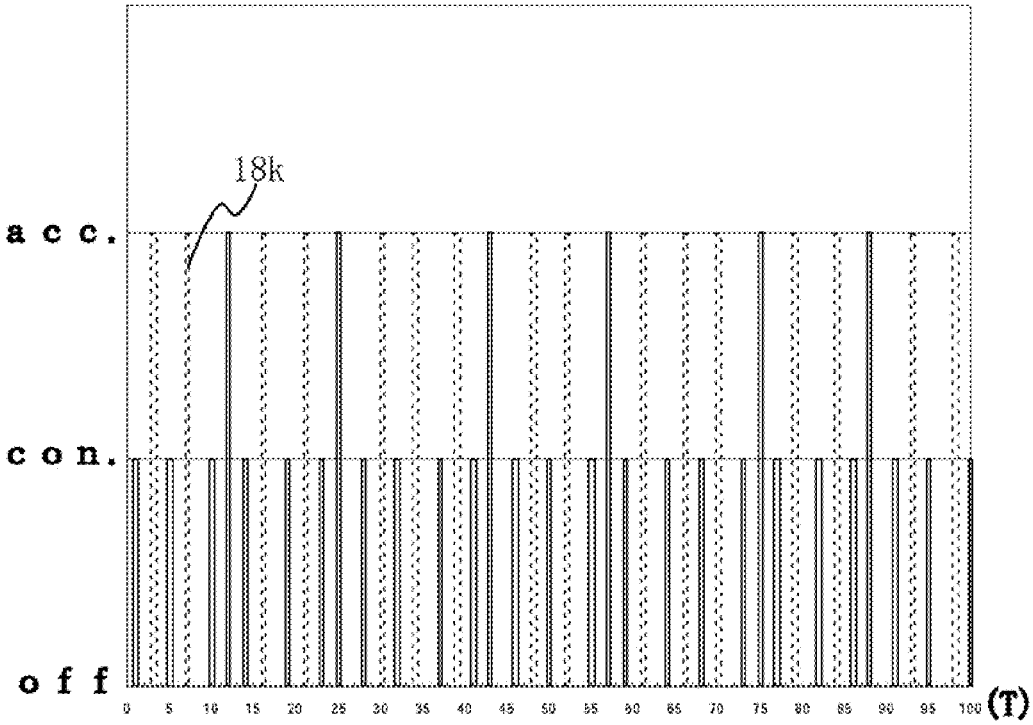
FIG. 12 shows a generation pattern of an induced voltage in the simulation in FIG. 11.

FIG. 12 shows part of the generation pattern of the induced voltage in acceleration simulation in FIG. 11. The axis of abscissa (T) represents the number of turns of the bunch 3 up to 100 turns, and on the axis of ordinate, acc. represents generation of the induced voltage for acceleration 18, con. represent generation of the barrier voltage, and off represents non-generation of the induced voltage 8.

The induced voltage for acceleration 18*k* shown by the dotted lines has been programmed in the induced voltage arithmetic unit 22 as timing generated in the induced voltage arithmetic unit 22, but is prevented from being generated because the energy level of the charged particle beam is more excessive than the equivalent acceleration voltage value pattern 24*b* calculated from the magnetic field excitation pattern 24.

If the magnetic field excitation pattern is provided, energy of the design particles at certain timing $t=t_0$ is provided. Thus, it is determined whether the energy level is excessive by comparing the energy level with the sum of the acceleration voltage values 18*c* intermittently supplied from the start of the acceleration to the timing $t=t_0$ multiplied by the charge e.

As is seen from the generation pattern of the induced voltage 8 in FIG. 12, among 100 turns of the bunch 3, the induced voltage 8 as the induced voltage for acceleration 18 is applied for 6 turns, and the induced voltage 8 as the barrier voltage 17 is applied for 22 turns. Thus, it can be seen that the charged particle beam can be accelerated by intermittently applying induced voltages 8 having the same pulse shape and multiple functions from a set of induction accelerating devices 5 rather than applying the induced voltages 8 for each turn of the bunch 3.

It can be also seen that since there are turns of the bunch 3 without application of the induced voltage 8, the induced voltage 8 that functions as the barrier voltage 17 for controlling the synchrotron oscillation frequency and the induced voltage 8 that functions as the induced voltage for acceleration 18 for controlling the beam orbit can be applied to the bunch 3 at the timing.

Figure 13:
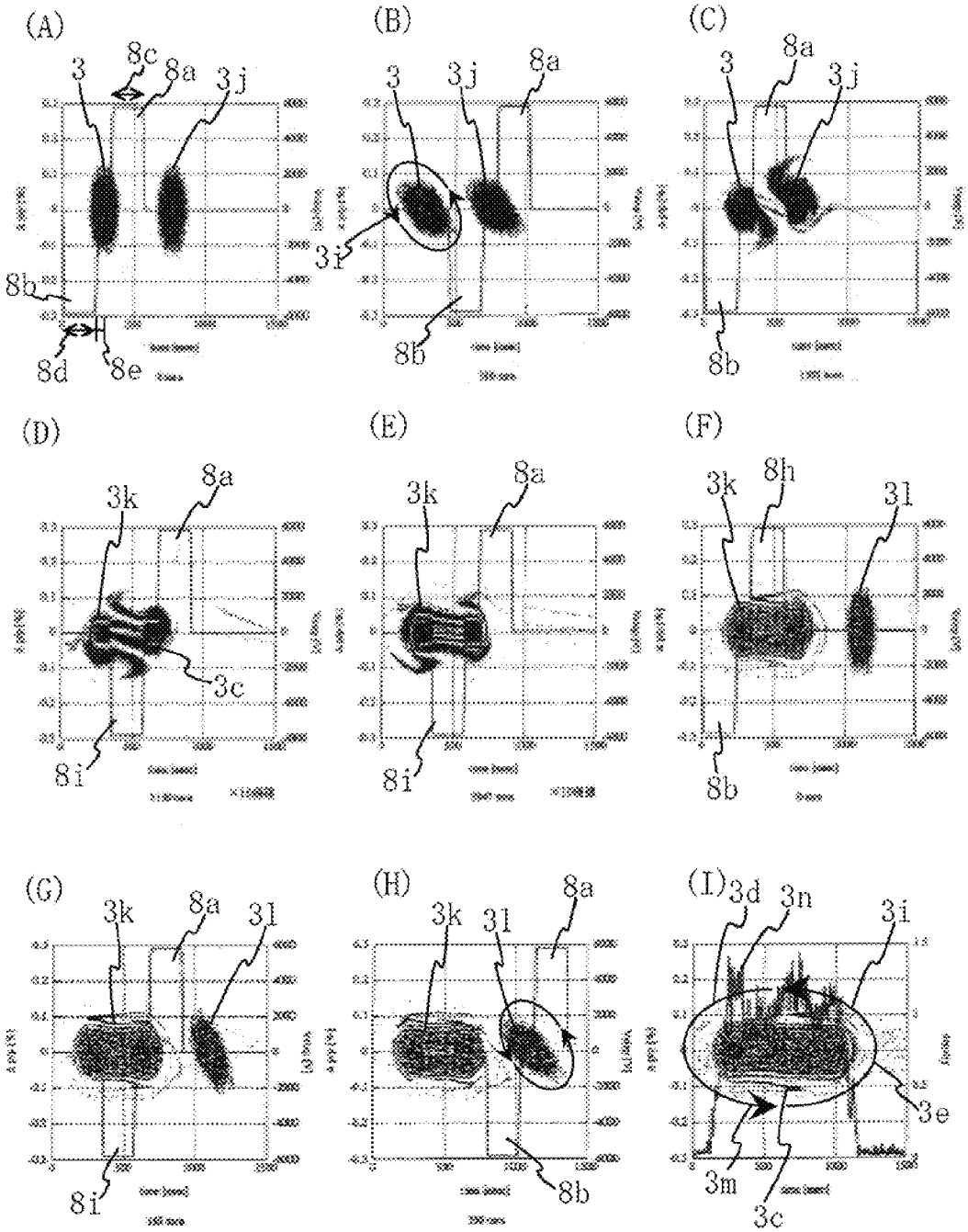
FIG. 13 shows a method (simulation) of forming a super-bunch by the acceleration method of a charged particle beam according to the present invention.

FIG. 13 shows a method (simulation) of forming a super-bunch by the acceleration method of a charged particle beam according to the present invention.

In order from FIGS. 13(A) to (I), three bunches 3, 3*j* and 3*l* are connected to form a super-bunch 3*m*. In FIGS. 13(A) to (F), turn represents the number of turns of the bunch with a turn at which the induced voltage 8 is first applied to the bunch 3 being the 0th turn, and in FIGS. 13(F) to (H), turn represents the number of turns of the bunch 3 with a turn at which the induced voltage 8 is first applied to a bunch 3*k* being the 0th turn, in the case where a third bunch 3*l* is connected to the bunch 3*k* that is a connection of the two bunches 3 and 3*j*.

The axis of abscissa time [nsec] represents a generation time of the induced voltage 8 with a time when the negative induced voltage 8*b* that functions as the negative barrier voltage 17*a* applied to the bunch 3 injected 16*a* into the vacuum duct 2*a* is first applied being zero. The axis of abscissa time [nsec] also represents a position of a phase space of the charged particles.

The first axis of ordinate Δp/p [%] represents a momentum deviation, which corresponds to displacement of energy of the charged particles. The second axis of ordinate Vstep [V] represents the voltage value of the induced voltage 8.

The simulation condition is as follows: the pulse amplitude is 5.8 kV, the charging time periods 8*c* and 8*d* are 250 nsec, a time duration between generations 8*e* of the positive and negative induced voltages 8*a* and 8*b* is 80 nsec. For the bunches 3, 3*j* and 3*l* injected 16*a* in the simulation, Δp/p(%) is 0.1%. Generation times of the positive and negative induced voltages 8*a* and 8*b* for confinement of the bunch 3 to be connected are moved toward the bunch to be connected by 10 nsec per 100 turns.

FIG. 13(A) shows a state where the bunch 3 is confined by the positive induced voltage 8*a* and the negative induced voltage 8*b* among the bunches 3 and 3*j* injected 16*a* into the vacuum duct 2*a*. Specifically, the induced voltage 8 applied here functions as the barrier voltage 17.

FIG. 13(B) shows a state of the 310th turn. The bunch 3*j* is confined by the positive induced voltage 8*a* and the negative induced voltage 8*b*. Specifically, the induced voltage 8 applied here functions as the barrier voltage 17 to the bunch 3*j*.

The bunches 3 and 3*j* receive the barrier voltage 17, and thus the occurrence of the synchrotron oscillation 3*i* can be found. Since only the negative induced voltage functions as the barrier voltage 17 to the bunch 3, the synchrotron oscillation 3*i* occurs on the right side of the bunch 3, and the charged particles are slightly diffused on the left side of the bunch 3.

FIG. 13(C) shows a state of the 1302nd turn. The bunch 3 and the bunch 3*j* are brought close to each other and partly integrated. The positive and negative induced voltages 8*a* and 8*b* here function as the barrier voltages 17 to the bunch 3. The positive induced voltage 8*a* partly influences (accelerates) the bunch head 3*d* of the bunch 3*j*, but the charged particles that constitute the bunch 3*j* do not extremely disappear.

FIGS. 13(D) and (E) show states of the 3130th turn and the 5947th turn. In FIGS. 13(D) and (E), it can be seen that the bunch 3*j* is gradually brought close and connected to the bunch 3 to form the bunch 3*k*. Herein, positive and negative induced voltages 8*h* and 8*i* that are used neither for the barrier voltage 17, for the induced voltage for acceleration 18, nor for control of the synchrotron oscillation frequency, that is, that have no function are applied.

In FIG. 13(D), the positive induced voltage 8*a* functions as the positive barrier voltage 17*b* to the bunch 3*k*. However, the negative induced voltage 8*i* is applied to a bunch center 3*c* of the bunch 3*k* newly formed by the connection of the two bunches 3 and 3*j*, as the induced voltage 8 in a direction opposite to the advancing axis direction 3*a*.

Thus, the negative induced voltage 8*i* is the induced voltage 8 having no function and unnecessary. However, unless the positive and negative induced voltages 8*a* and 8*b* are alternately applied, electrical saturation of the magnetic material 6*c* occurs as described above to prevent application of the induced voltage 8.

Thus, such unnecessary positive and negative induced voltages 8*a* and 8*b* are applied in pairs at the close numbers of turns and cancel each other out, thereby reducing influence of the unnecessary positive and negative induced voltages 8*a* and 8*b* to the charged particle beam. Also in FIG. 13(E), the negative induced voltage 8*i* is unnecessary.

Comparing the time duration between generations 8*e* of the positive and negative induced voltages 8*a* and 8*b* in FIGS. 13(B) and (D), (D) shows the state of the turn of the bunch 3 about 2800 turns after (B), and it can be seen that the generation is about 280 nsec earlier (about 2800 turns/100 turns×10 nsec=about 280 nsec).

FIG. 13(F) shows a first stage (the 0th turn) in the case where another bunch 3*l* is connected to the bunch 3*k* newly formed by the connection of the two bunches 3 and 3*j*. The time duration between generations 8*e* of the positive and negative induced voltages 8*a* and 8*b* is returned to 80 nsec as in FIG. 13(A).

Herein, the negative induced voltage 8*b* applied to the bunch 3*k* functions as the negative barrier voltage 17*a*. The positive induced voltage 8*a* is applied to the bunch center 3*c* of the bunch 3*k* as the positive induced voltage 8*h* having no function. Similarly, the negative induced voltage 8*i* in FIG. 13(G) showing the 165th turn is also unnecessary. The positive and negative induced voltages 8*h* and 8*i* having no function are applied at the close number of turns, and cancel each other out in pairs.

FIG. 13(H) shows a state of the 330th turn, in which the positive and negative induced voltages 8*a* and 8*b* are applied to the third bunch 3*l* newly connected. The induced voltage 8 has the function of confinement of the bunch 3*l* and thus functions as the barrier voltage 17. Also herein, the synchrotron oscillation 3*i* can be seen.

FIG. 13(I) shows particle density distribution 3*n* of the formed super-hunch 3*m*. The axis of abscissa time [nsec] represents a time width in which charged particles exist with the generation time of the negative induced voltage 8*b* applied to the bunch head 3*d* by the induction accelerating cell 6 being zero. Also herein, the synchrotron oscillation 3*i* can be seen.

The first axis of ordinate Δp/p [%] represents momentum deviation, which corresponds to displacement of energy of the charged particles. The second axis of ordinate density represents particle density distribution 3*n* of the charged particles, and the unit thereof is relative ratio.

The negative induced voltage 8*b* having the same function as the negative barrier voltage 17*a* is applied to the bunch head 3*d*, and the positive induced voltage 8*a* having the same function as the positive barrier voltage 17*a* is applied to the bunch tail 3*e*, thereby confining the super-bunch 3*m*. This allows confinement of the super-bunch 3*m* and control of the synchrotron oscillation frequency.

In this manner, the set of induction accelerating device 5 according to the present invention can be used to intermittently supply the induced voltage 8 to connect the multiple bunches 3 to form the super-bunch 3*m*. The time duration between generations 8*e* of the positive and negative induced voltages 8*a* and 8*b* is adjusted to the length of the super-bunch 3*m* to allow confinement, and the charging time period 18*e* for applying the voltage to the entire length of super-bunch 3*m* is ensured to accelerate the super-bunch 3*m* up to the an arbitrary energy level.

A device and a method for applying the acceleration voltage 18*a* to the entire super-bunch 3*m* will be described in detail with reference to FIG. 14.

Figure 14:
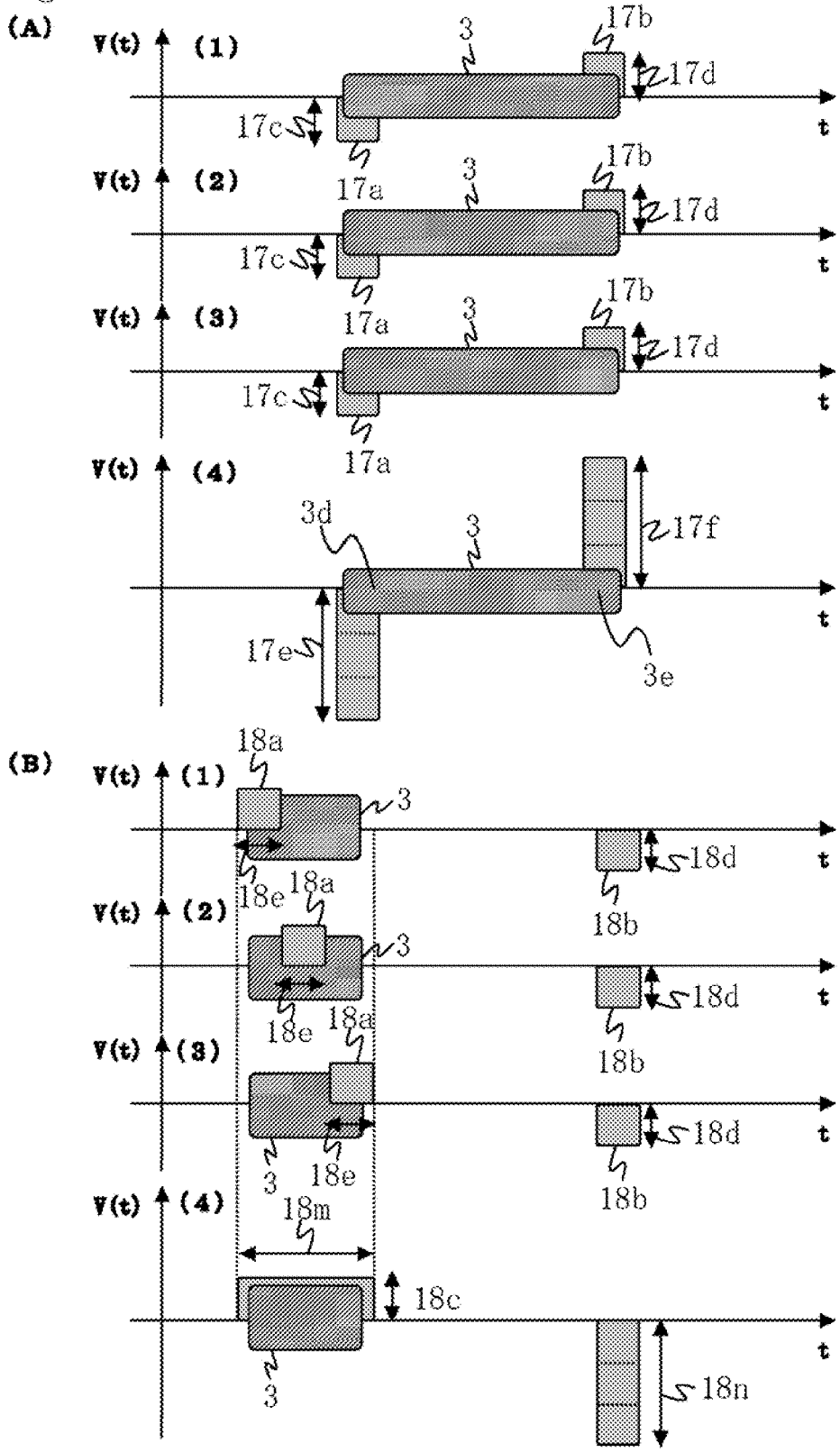
FIG. 14 shows an example of changing an induced voltage value using multiple induction accelerating cells.

FIG. 14 shows an example of changing an induced voltage value using multiple induction accelerating cells. Generally, a charging time period and a voltage value are required such that the negative and positive barrier voltages 17*a* and 17*b* are relatively high in a short charging time period, the acceleration voltage 18*a* is relatively low in a long charging time period, and the reset voltage 18*b* is equal in energy to the acceleration voltage 18*a*.

The above described requirement can be easily satisfied by using the multiple induction accelerating cells 6. Thus, an operation pattern in use of triple induction accelerating cells 6 will be described. This method allows an increase in flexibility of selection of charged particles and attainable energy levels.

FIG. 14(A) shows the level of the barrier voltage 17 supplied by the triple induction accelerating cells 6 and the charging time period. The axis of abscissa t represents the charging time period of the barrier voltage 17 and the axis of ordinate V(t) represents the voltage value of the barrier voltage 17.

In FIG. 14(A), (1), (2) and (3) denote barrier voltages 17 applied from the first induction accelerating cell 6, the second induction accelerating cell 6, and the third induction accelerating cell 6, respectively. (4) denotes the total negative and positive barrier voltage values 17*e* and 17*f* applied to the bunch 3 by the triple induction accelerating cells 6.

A negative barrier voltage 17*a* is first applied to the bunch head 3*d* of the bunch 3 that has reached the triple induction accelerating cells 6 at the same number of turns in order from (1) to (3). At this time, the bunch 3 circulates at high speed, and it is only necessary that the negative barrier voltages 17*a* from (1) to (3) are applied substantially at the same time.

Similarly, the positive barrier voltages 17*b* are applied to the bunch tail 3*e*. Thus, the voltage values equal to the total positive barrier voltage values 17*e* and 17*f* in (4) are applied to the bunch 3 at the bunch head 3*d* and the bunch tail 3*e*.

In this manner, the induction accelerating cells 6 are combined to shift generation timing of the induced voltages of the induction accelerating cells 6 at the same number of turns, thereby allowing high barrier voltage values 17*e* and 17*f* to be obtained even if the negative and positive barrier voltage values 17*c* and 17*d* applied by each induction accelerating cell 6 are low. Specifically, the voltage values of effectively required barrier voltages 17 (the positive and negative induced voltages 8*a* and 8*b* that function as the barrier voltages 17) can be easily changed. This requires the same number of induction accelerating devices 5 as that of the induction accelerating cells 6.

In the case where the barrier voltages are intermittently supplied at different turns rather than at the same turn, the barrier voltage value becomes an average value using the number of turns, and becomes lower than the negative and positive barrier voltage values 17*c* and 17*d* applied by the induction accelerating cell 6. In this case, the set of induction accelerating device 5 can easily change the voltage value of the effectively required barrier voltage 17. This is cost-effective because the multiple induction accelerating cells 6 are not required.

FIG. 14(B) represents the level of the induced voltage for acceleration 18 supplied by the triple induction accelerating cells 6 and the charging time period 18*e*. The axis of abscissa t represents the charging time period 18*e* of the induced voltage for acceleration 18, and the axis of ordinate V(t) represents the voltage value of the induced voltage for acceleration 18.

In FIG. 14(B), (1), (2) and (3) represent induced voltages for acceleration 18 applied from the first induction accelerating cell 6, the second induction accelerating cell 6, and the third induction accelerating cell 6, respectively. (4) represents the total charging time period 18*m* of the acceleration voltage 18*a* applied to the bunch 3 by the triple induction accelerating cells 6 and the total reset voltage value 18*n*.

An acceleration voltage 18*a* at a certain acceleration voltage value 18*c* is first applied to the bunch 3 that has reached the triple induction accelerating cells 6 at the same number of turns in order from (1) to (3). At this time, the charging time periods are shifted from (1) to (3), and thus the acceleration voltages 18*a* can be applied to the bunch 3.

This ensures a charging time period equal to the total charging time period 18*m* in (4) for the entire bunch 3.

A reset voltage 18*b* is applied for avoiding magnetic saturation of the triple induction accelerating cells 6 in a time period when no bunch 3 exists in the induction accelerating cells 6. The total reset voltage value 18*n* is effectively three times higher than the reset voltage 18*b*, but a voltage applied to each induction accelerating cell 6 is substantially equal to or lower than the reset voltage 18*b*, and there is lower risk of breakage due to discharge than in the case where one induction accelerating cell 6 supplies the acceleration voltage 18*a* and the reset voltage value 18*n*.

In the case where the acceleration voltages 18*a* are intermittently supplied at different turns rather than at the same turn, like the barrier voltage 17, the charging time period of the effectively required acceleration voltage 18*a* (positive induced voltage 8*a* that functions as the acceleration voltage 18*a*) can be ensured by the set of induction accelerating device 5. The same applies to the reset voltage 18*b* (negative induced voltage 8*b* that functions as the reset voltage 18*b*).

In theory, the time period other than the time period for the application of the reset voltage 18*b* can be used as the time period for the application of the acceleration voltage 18*a*, thereby allowing an arbitrary charged particle beam to be accelerated as the super-bunch 3*m*.

In this manner, even if one induction accelerating cell 6 can apply the acceleration voltage 18*a* only in a short charging time period 18*e*, the induction accelerating cells are combined to ensure a long charging time period 18*m*. Specifically, the two functions of confinement and acceleration can be sufficiently exerted even by the induction accelerating cell that can only generate a low induced voltage. This can reduce production costs of an accelerator using the induction accelerating cell 6.

Figure 15:
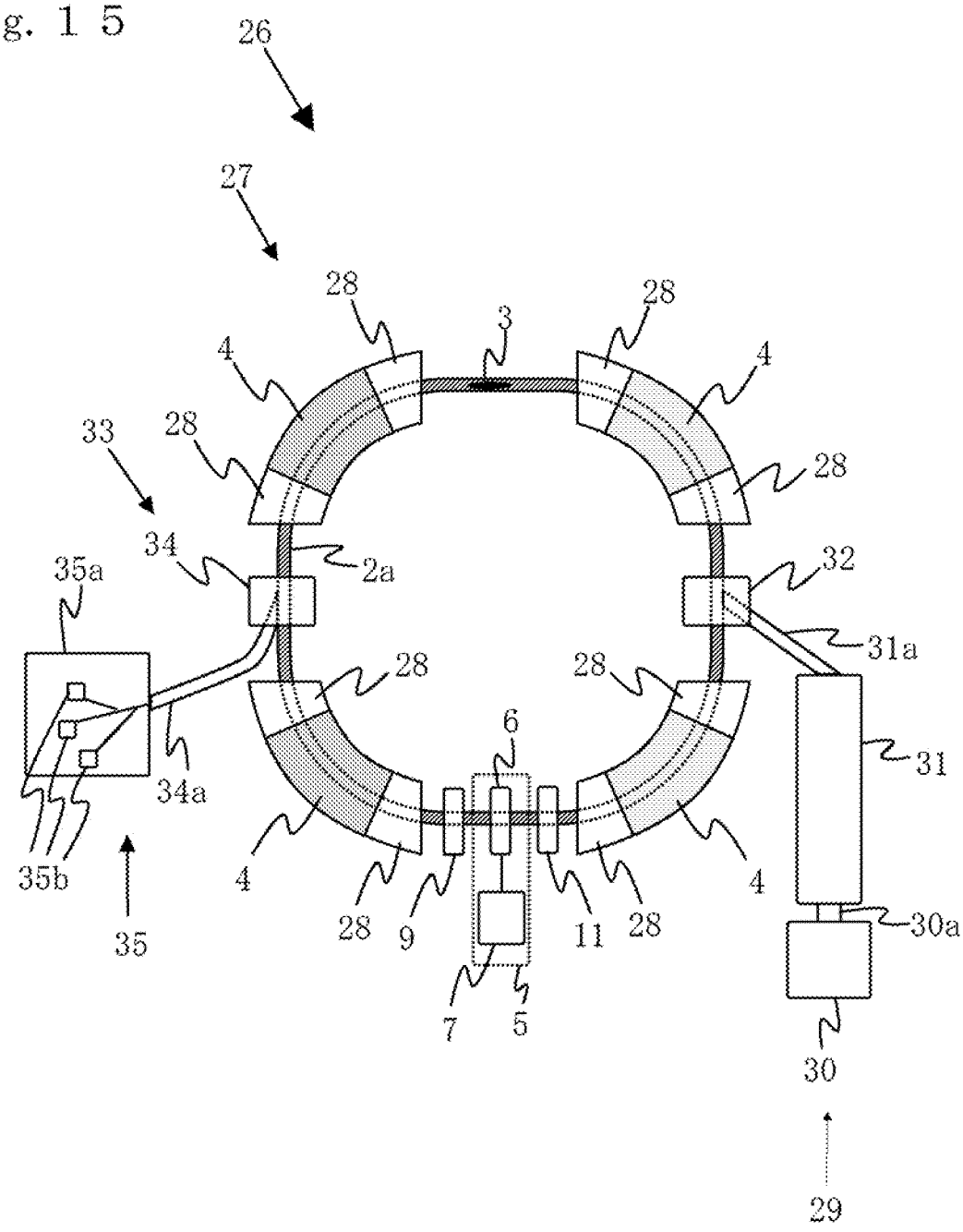
FIG. 15 is a general block diagram of an accelerator including the induction accelerating device according to the present invention.
Figure 16:
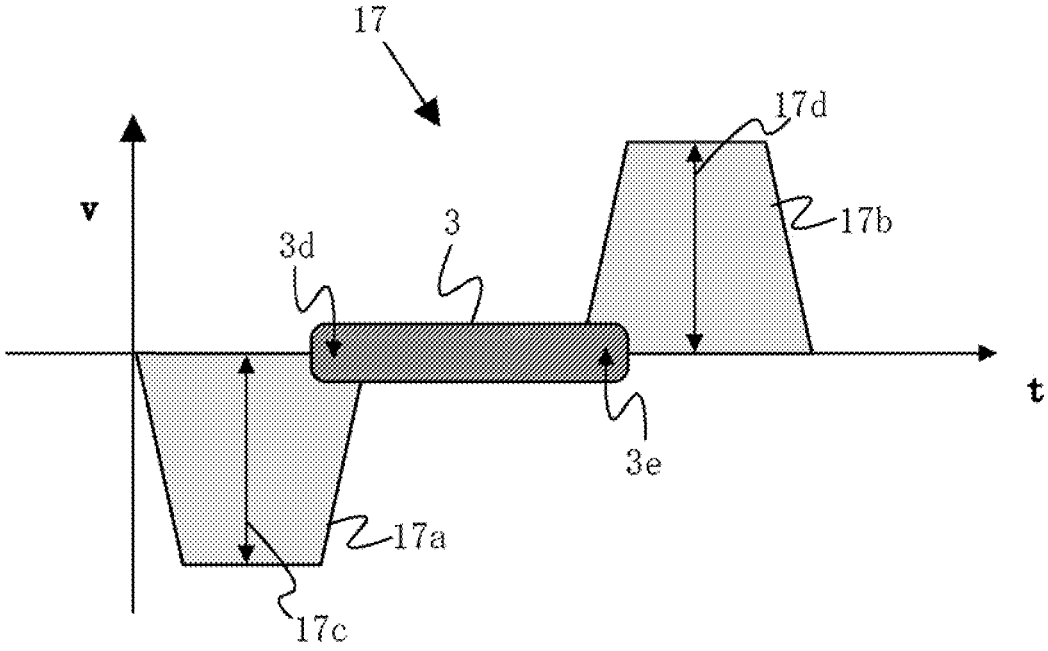
FIG. 16 shows an acceleration principle of a charged particle beam by induced voltages applied from conventional induction accelerating cells having different functions.
Figure 16:
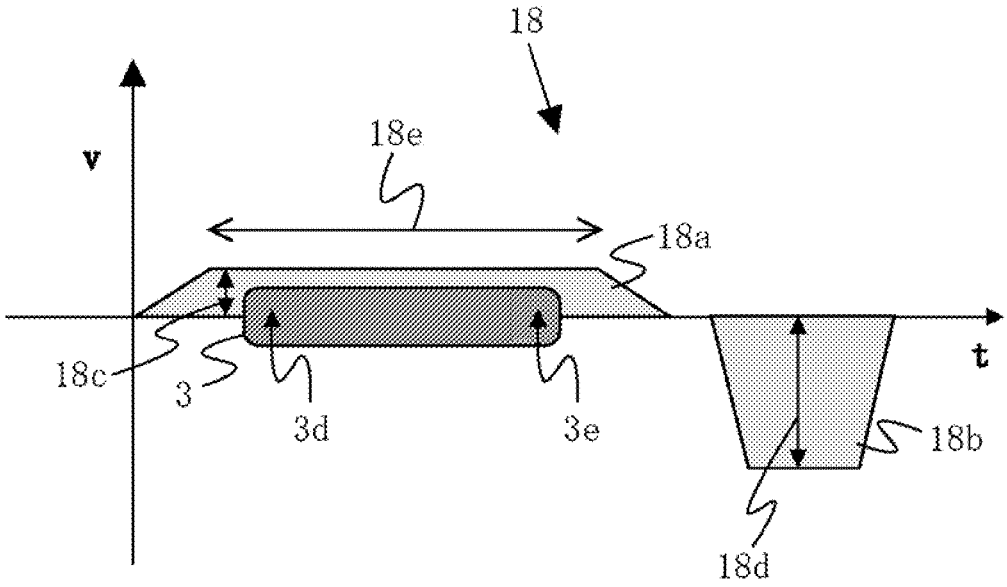
Figure 17:
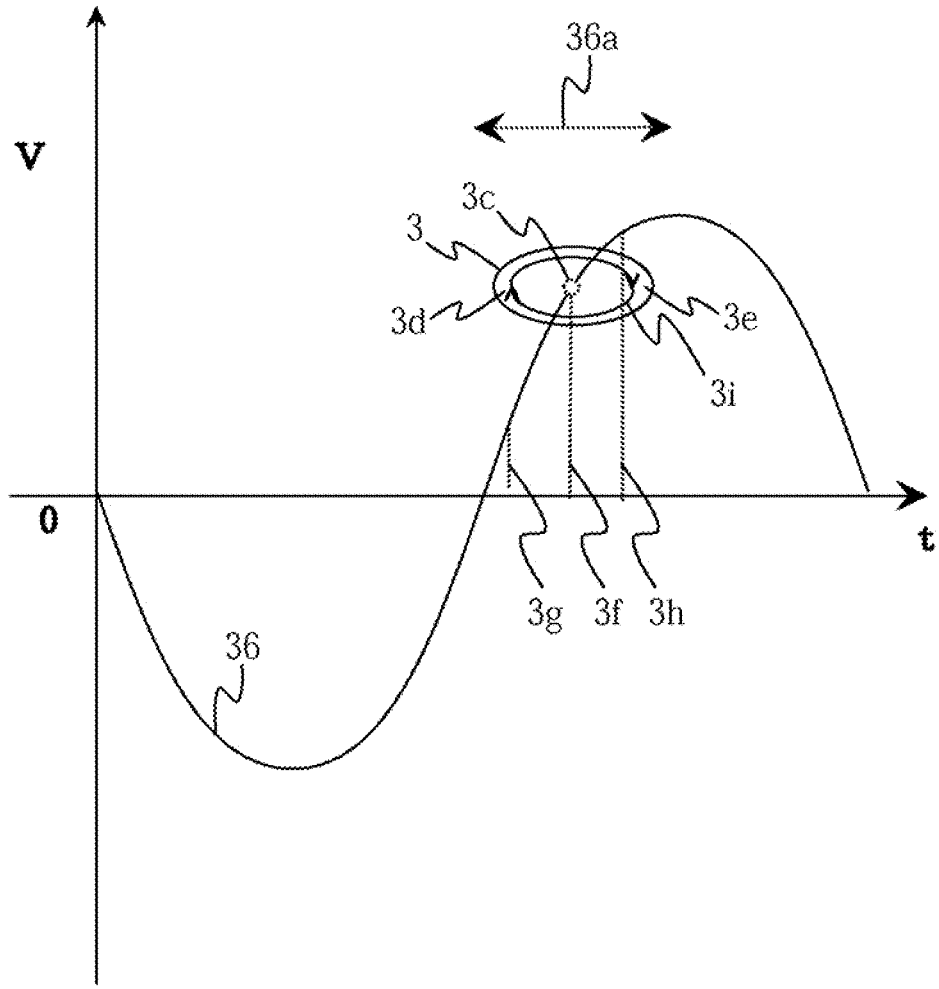
FIG. 17 shows synchrotron oscillation.
Figure 18:
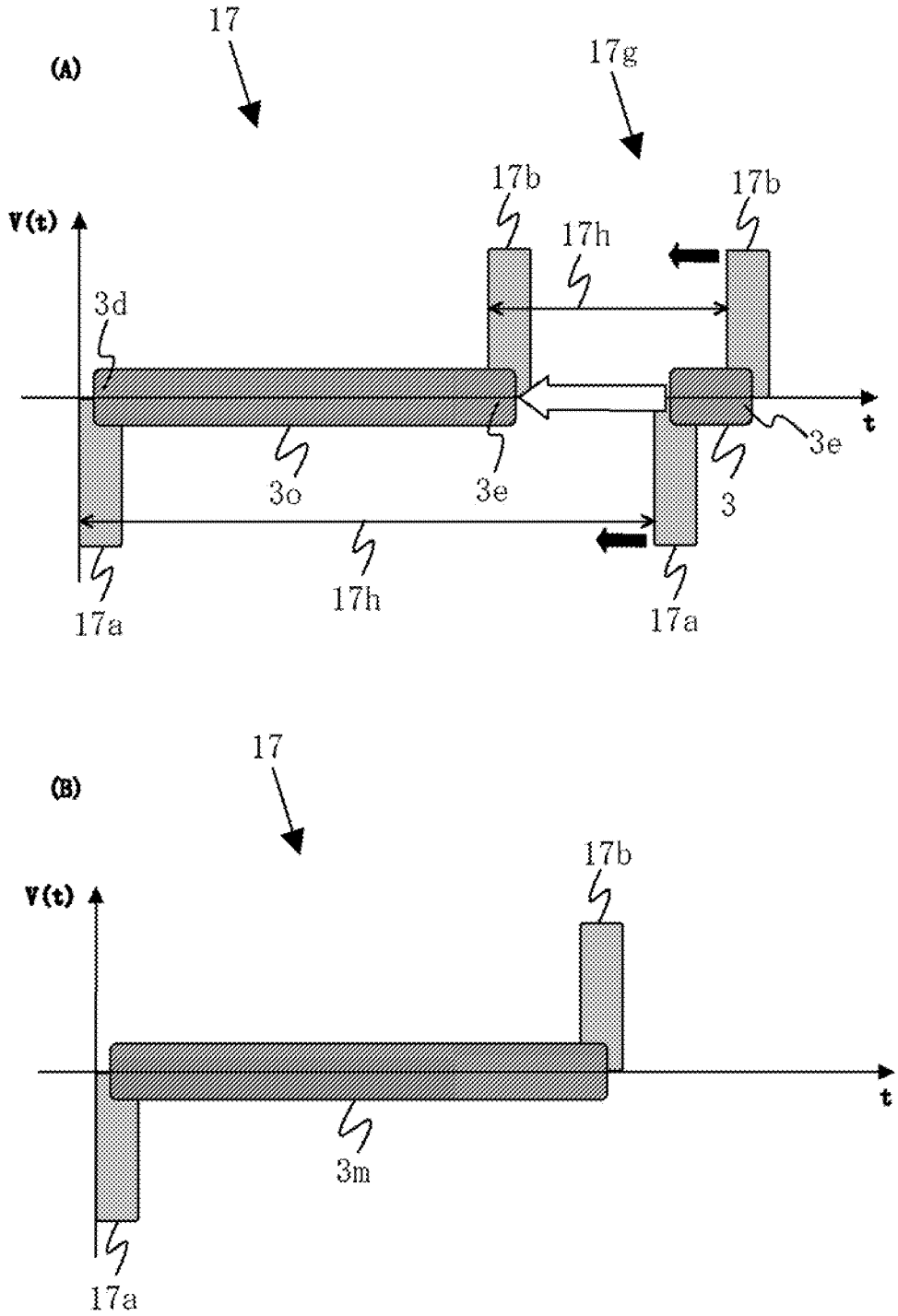
FIG. 18 shows an example of a conventional forming process of a super-bunch by an induced voltage.

FIG. 15 is a general block diagram of an accelerator including an induction accelerating device according to the present invention. In the accelerator 26 according to the present invention, devices used in a conventional complex of rf synchrotron devices may be used as devices other than an induction accelerating device 5 for controlling acceleration of a bunch 3.

The accelerator 26 includes an injection device 29, an induction synchrotron 27, and an extraction device 33. The injection device 29 includes an ion source 30, a preinjector 31, an injector 32, and transport pipes 30*a* and 31*a* that connect the devices and are communication passages for a charged particle beam, upstream of the induction synchrotron 27.

As the ion source 30, an ECR ion source using an electronic cyclotron resonance heating mechanism, a laser driven ion source, or the like is used.

As the preinjector 31, a variable-voltage electrostatic accelerator or a linear induction accelerator is generally used. When the kind of charged particles to be used is determined, a small-sized cyclotron may be used.

As the injector 32, a device used in the complex of rf synchrotron is used. No particular device and method is required for the accelerator 26 of the present invention.

In the injection device 29 having the above described configuration, the charged particles generated by the ion source 30 are accelerated by the preinjector 31 up to a certain energy level and injected into the induction synchrotron 27 by the injector 32.

The induction synchrotron 27 includes an annular vacuum duct 2*a* having a design orbit 2 of the charged particle beam therein, a bending magnet 4 that is provided on a curved portion of the design orbit 2 and holds a circular orbit of the charged particle beam, a focusing electromagnet 28 that is provided on a linear portion of the design orbit 2 and prevents diffusion of the bunch 3, a bunch monitor 9 that is provided in the vacuum duct 2*a* and detects passage of the bunch 3, a position monitor 11 that is provided in the vacuum duct 2*a* and detects the center of gravity position of the bunch 3, and the induction accelerating device 5 that is connected to the vacuum duct 2*a* and controls generation timing of induced voltages 8 for confinement and acceleration of the bunch 3 in an advancing axis direction 3*a*.

The induction accelerating device 5 has a configuration shown in FIG. 1, and a digital signal processing device 12 has a configuration shown in FIG. 9. The induction accelerating device 5 controls the generation timing of the induced voltage 8, confines and accelerates the charged particle beam, and moves the bunch 3. The confinement provides phase stability to the bunch 3 to control the synchrotron oscillation frequency of the bunch 3. Further, the acceleration voltage 18*a* can be applied to freely control a revolution orbit of the charged particle beam.

Since the bunch 3 can be moved, multiple bunches 3 can be connected to form and accelerate a super-bunch 3*m*.

The extraction device 33 includes a transport pipe 34*a* that connects to a facility 35*a* in which experimental devices 35*b* or the like using the charged particle beam accelerated up to the predetermined energy level by the induction synchrotron 27 are placed, and an extraction system 34 that extracts the charged particle beam to a beam utility line 35. The experimental devices 35*b* include medical facilities used for therapy.

As the extraction system 34, a kicker magnet for rapid extraction, or a device for slow extraction using betatron resonance or the like may be used, and the extraction system can be selected depending on the kinds and the ways of use of the charged particle beam.

With the above described configuration, the accelerator 26 of the present invention by itself can accelerate all charged particles up to an arbitrary energy level.

Industrial Applicability

The present invention has the above described configuration and can obtain the following advantages. First, one set of induction accelerating device 5 can control the generation timing of the positive induced voltage 8*a* and the negative induced voltage 8*b*, and apply the induced voltages 8 to the charged particle beam at arbitrary timing. Thus, the charged particle beam can be synchronized with the magnetic field excitation patterns 15 and 24 by the bending magnet 4, the charged particle beam can be sufficiently confined in the charging time period 18*e* of the acceleration voltage 18*a*, the synchrotron oscillation frequency can be controlled, further the beam orbit can be controlled, and arbitrary charged particle beams in all charged states that may be taken in principle can be accelerated up to an arbitrary energy level.

Second, the generation timing of the induced voltage 8 can be controlled to reduce the time duration between generations 8*e* of the induced voltages 8 that function as the barrier voltages 17 applied by the set of induction accelerating device 5 to form the super-bunch 3*m*.

Third, the set of induction accelerating device 5 controls the induced voltages 8 having multiple functions, thereby significantly increasing flexibility of acceleration control of the charged particle beam.

Fourth, the set of induction accelerating device 5 controls acceleration of the charged particle beam to reduce construction costs of the accelerator. Thus, arbitrary charged particle beams for medical use can be provided at low costs. The set of induction accelerating device 5 may be simply incorporated into the conventional rf synchrotron.

The invention claimed is:

1. An induction accelerating device in a synchrotron, characterized in that said induction accelerating device comprises:

one induction accelerating cell that applies a barrier voltage for confinement of a charged particle beam in an advancing axis direction and an induced voltage for acceleration for accelerating the charged particle beam;

a switching power supply that supplies a pulse voltage to said induction accelerating cell via a transmission line and drives said induction accelerating cell;

a DC power supply that supplies electric power to said switching power supply; and an intelligent control device including a pattern generator that generates a gate signal pattern for controlling on/off said switching power supply, and a digital signal processing device that controls on/off a gate master signal that becomes the basis of said gate signal pattern, and said induction accelerating device controls generation timing of said induced voltage.

2. The induction accelerating device according to claim 1, characterized in that said digital signal processing device includes:

a variable delay time calculator that stores a required variable delay time pattern corresponding to an ideal variable delay time pattern calculated on the basis of magnetic field excitation patterns, and generates a variable delay time signal on the basis of said required variable delay time pattern;

a variable delay time generator that receives a passage signal of a charged particle beam from a bunch monitor placed on a design orbit along which a charged particle beam circulates and the variable delay time signal from said variable delay time calculator to generate a pulse corresponding to a variable delay time;

an induced voltage arithmetic unit that stores an equivalent acceleration voltage value pattern corresponding to an ideal acceleration voltage value pattern calculated on the basis of the magnetic field excitation patterns, and receives the pulse corresponding to the variable delay time from said variable delay time generator to generate a pulse for controlling on/off the induced voltage; and a gate master signal output device that receives the pulse from said induced voltage arithmetic unit to generate the gate master signal that is a pulse suitable for the pattern generator, and outputs the gate master signal after a lapse of the variable delay time, and said induction accelerating device controls generation timing of the induced voltage.

3. The induction accelerating device according to claim 2, characterized in that said variable delay time calculator calculates the variable delay time in real time on the basis of a beam deflection magnetic field strength signal indicating magnetic field strength of a bending magnet that constitutes the synchrotron, and a revolution frequency of the charged particle beam on the design orbit, and generates the variable delay time signal on the basis of said variable delay time.

4. The induction accelerating device according to claim 3, characterized in that said induced voltage arithmetic unit calculates an acceleration voltage value in real time on the basis of the beam deflection magnetic field strength signal indicating the magnetic field strength of the bending magnet that constitutes the synchrotron, and receives the pulse corresponding to the variable delay time from said variable delay time generator to generate the pulse for controlling on/off an induced voltage for acceleration.

5. The induction accelerating device according to claim 2, characterized in that said induced voltage arithmetic unit calculates an acceleration voltage value in real time on the basis of the beam deflection magnetic field strength signal indicating the magnetic field strength of the bending magnet that constitutes the synchrotron, and receives the pulse corresponding to the variable delay time from said variable delay time generator to generate the pulse for controlling on/off an induced voltage for acceleration.

6. An acceleration method of a charged particle beam in a synchrotron using the induction device according to claim 1, characterized by comprising the steps of:

controlling generation timing of induced voltages including a positive induced voltage having the same rectangular pulse shape and a negative induced voltage having the same rectangular pulse shape, applied from a set of induction accelerating device according to claim 1;

intermittently applying an induced voltage for acceleration as an equivalent acceleration voltage value pattern corresponding to an ideal acceleration voltage value pattern without applying the induced voltages for each turn of the charged particle beam in a unit of control that is the number of turns of the charged particle beam in a certain time period; and applying a barrier voltage for confinement of the charged particle beam and an induced voltage for controlling a synchrotron oscillation frequency in a time period without application of the induced voltage for acceleration.

7. The acceleration method of a charged particle beam according to claim 6 characterized in that a plurality of said of induction accelerating cells are provided, and induced voltages are applied from a plurality of induction accelerating cells to a charge particle beam that has reached the induction accelerating cells at the same turn to change values of the induced voltages applied to the charged particle beam, or application timing of the induced voltages applied from the plurality of induction accelerating cells is shifted to change charging time periods for applying the induced voltages to the charged particle beam.

8. The induction accelerating device according to claim 1 characterized in that a plurality of said induction accelerating cells are provided and induced voltages are applied from a plurality of induction accelerating cells to a charted article beam that has reached the induction accelerating cells at the same turn to change values of the induced voltages applied to the charged particle beam, or application timing of the induced voltages applied from the plurality of induction accelerating cells is shifted to change charging time periods for applying the induced voltages to the charged particle beam.

9. An accelerator for accelerating an arbitrary charged particle beam and comprising the induction accelerating device according to claim 1, characterized by comprising:

an injection device including an ion source that generates charged particles, a preinjector that accelerates said charged particles up to a certain energy level, and an injector that injects a charged particle beam accelerated by said preinjector into an annular vacuum duct having a design orbit therein;

an induction synchrotron including a bending electromagnet that is provided on a curved portion of said design orbit and ensures the design orbit of said charged particle beam, a focusing electromagnet that is provided on a linear portion of said design orbit and ensures strong focusing of said charged particle beam, a bunch monitor that is provided in said vacuum duct and detects passage of the charged particle beam, and the induction accelerating device connected to said vacuum duct for controlling acceleration of the charged particle beam; and an extraction device including an extractor that extracts the charged particle beam accelerated up to a predetermined energy level by said induction synchrotron to a beam utility line.

10. The accelerator according to claim 9, characterized in that said preinjector is an electrostatic accelerator, a linear induction accelerator, or a small-sized cyclotron.

* * * * *

UNITED STATES PATENT AND TRADEMARK OFFICE

CERTIFICATE OF CORRECTION

PATENT NO. : 8,456,110 B2
APPLICATION NO. : 12/097657
DATED : June 4, 2013
INVENTOR(S) : Takayama et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1380 days.

Signed and Sealed this
Eighth Day of September, 2015

Michelle K. Lee

Michelle K. Lee
*Director of the United States Patent and Trademark Office*